US010364549B2

(12) United States Patent
Hita et al.

(10) Patent No.: US 10,364,549 B2
(45) Date of Patent: Jul. 30, 2019

(54) HYBRID CONSTRUCTION MACHINE

(71) Applicant: Hitachi Construction Machinery Co., Ltd., Taito-ku, Tokyo (JP)

(72) Inventors: Masafumi Hita, Tsuchiura (JP); Shinya Imura, Toride (JP); Shiho Izumi, Hitachinaka (JP); Hidekazu Moriki, Mito (JP); Hiroaki Amano, Tsukuba (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 90 days.

(21) Appl. No.: 15/545,527

(22) PCT Filed: Jan. 19, 2016

(86) PCT No.: PCT/JP2016/051414
§ 371 (c)(1),
(2) Date: Jul. 21, 2017

(87) PCT Pub. No.: WO2016/117547
PCT Pub. Date: Jul. 28, 2016

(65) Prior Publication Data

US 2017/0356163 A1 Dec. 14, 2017

(30) Foreign Application Priority Data

Jan. 23, 2015 (JP) ..... 2015-011173

(51) Int. Cl.
*E02F 9/00* (2006.01)
*E02F 9/20* (2006.01)
(Continued)

(52) U.S. Cl.
CPC ..... *E02F 9/2058* (2013.01); *E02F 3/425* (2013.01); *E02F 9/08* (2013.01); *E02F 9/20* (2013.01);
(Continued)

(58) Field of Classification Search
CPC ... E02F 9/2058; E02F 9/08; E02F 9/20; E02F 9/2037; E02F 9/2075; E02F 9/2203;
(Continued)

(56) References Cited

U.S. PATENT DOCUMENTS 7,525,206 B2 * 4/2009 Kagoshima ..... B60K 6/12 290/40 C
8,087,240 B2 * 1/2012 Morinaga ..... B66C 1/42 60/414
(Continued)

FOREIGN PATENT DOCUMENTS

EP 1 720 244 A1 11/2006
JP 2010-248870 A 11/2010
(Continued)

OTHER PUBLICATIONS

Extended European Search Report issued in counterpart European Application No. 16740154.6 dated Jul. 26, 2018 (seven pages).
(Continued)

*Primary Examiner* — John D Walters
(74) *Attorney, Agent, or Firm* — Crowell & Moring LLP

(57) ABSTRACT

A motor-generator (27) is connected mechanically to an engine (21) and a hydraulic pump (23). The hydraulic pump (23) delivers pressurized oil to cylinders (12D) to (12F) in a working mechanism (12), a traveling hydraulic motor (25) and a revolving hydraulic motor (26). The revolving hydraulic motor (26) drives a revolving device (3) in cooperation with a revolving electric motor (33). An HCU (36) reduces outputs of the revolving electric motor (33), the revolving hydraulic motor (26), the boom cylinder (12D) and the like such that a ratio of a revolving speed of an upper revolving structure (4) and a movement speed of raising a boom (12A) is held to a ratio in a normal mode (NMODE) at the time of performing a compound movement of a revolving move-
(Continued)

ment and a boom-raising movement in a low speed mode (LSMODE).

5 Claims, 16 Drawing Sheets

(51) Int. Cl.

| | |
|---|---|
| ***F15B 11/00*** | (2006.01) |
| ***E02F 3/42*** | (2006.01) |
| ***E02F 9/08*** | (2006.01) |
| ***E02F 9/22*** | (2006.01) |
| ***E02F 9/26*** | (2006.01) |
| ***F15B 11/16*** | (2006.01) |
| *E02F 3/30* | (2006.01) |
| *E02F 3/32* | (2006.01) |

(52) U.S. Cl.
CPC ..... *E02F 9/2037* (2013.01); *E02F 9/2075* (2013.01); *E02F 9/2203* (2013.01); *E02F 9/26* (2013.01); *F15B 11/00* (2013.01); *F15B 11/16* (2013.01); *E02F 3/301* (2013.01); *E02F 3/32* (2013.01); *F15B 2211/7058* (2013.01); *F15B 2211/75* (2013.01); *Y10S 903/93* (2013.01)

(58) Field of Classification Search
CPC ... E02F 9/26; E04F 3/425; E04F 3/301; E04F 3/32; F15B 11/00; F15B 11/16; F15B 2211/7058; F15B 2211/75; Y10S 903/93
USPC ..... 180/65.265
See application file for complete search history.

(56) References Cited

U.S. PATENT DOCUMENTS

| | | | | |
|---|---|---|---|---|
| 8,364,333 | B2 * | 1/2013 | Yanagisawa ..... | B60K 6/46 701/22 |
| 2009/0301075 | A1 | 12/2009 | Morinaga et al. | |
| 2010/0268407 | A1 | 10/2010 | Yanagisawa | |
| 2014/0137548 | A1 | 5/2014 | Imura et al. | |

FOREIGN PATENT DOCUMENTS

| | | | |
|---|---|---|---|
| JP | 2013-24387 | A | 2/2013 |
| WO | WO 2007/052538 | A1 | 5/2007 |

OTHER PUBLICATIONS

International Search Report (PCT/ISA/220 & PCT/ISA/210) issued in PCT Application No. PCT/JP2016/051414 dated Mar. 8, 2016 with English translation (five pages).
Japanese-language Written Opinion (PCT/ISA/237) issued in PCT Application No. PCT/JP2016/051414 dated Mar. 8, 2016 (four pages).

* cited by examiner

HYBRID CONSTRUCTION MACHINE

TECHNICAL FIELD

The present invention relates to a hybrid construction machine on which an engine and a motor-generator are mounted.

BACKGROUND ART

In general, there is known a hybrid construction machine provided with a motor-generator that is jointed mechanically to an engine and a hydraulic pump, and an electricity storage device such as an lithium ion battery or a capacitor (for example, refer to Patent Document 1). In this hybrid construction machine, the motor-generator plays a role of charging power generated by a driving force of the engine in the electricity storage device or assisting in the engine by a powering operation using power of the electricity storage device. Many hybrid construction machines are provided with an electric motor separated from the motor-generator, and the electric motor acts for or assists in a movement of a hydraulic actuator. For example, at the time of performing a revolving movement by the electric motor, the electric motor performs or assists in the revolving movement of an upper revolving structure by power supply to the electric motor, and braking energy at a revolving stop is regenerated to perform a charge of the electricity storage device.

Here, Patent Document 1 discloses a hybrid construction machine provided with a plurality of electric actuators such as a motor-generator, a revolving electric motor, a traveling generator, a lifting magnet and the like, the hybrid construction machine being configured so that in a case where the plurality of electric actuators simultaneously require large power and a total value thereof goes beyond a power supply limit of an electricity storage device, the power is distributed according to preliminarily determined priority of each of the electric actuators.

PRIOR ART DOCUMENT

Patent Document

Patent Document 1: Japanese Patent Laid-Open No. 2010-248870 A

SUMMARY OF THE INVENTION

In the hybrid construction machine described in Patent Document 1, even when a power supply amount of the electricity storage device is not sufficient, movement performance of the electric actuator having high priority can be ensured, but at the time of simultaneously driving the plurality of electric actuators, a movement balance thereof is not considered.

For example, when gravel or earth and sand are loaded into a dump truck by an excavator, a movement of revolving/boom-raising of raising a boom while revolving is frequently performed. In this movement, it is desirable that a front portion (working mechanism) including the boom always draws the same trace in the same lever operating amount. However, in the hybrid construction machine described in Patent Document 1, since the power is distributed according to the priority of the electric actuator when the power supply amount of the electricity storage device is lacking, a ratio of the power supply to a revolving electric motor and a motor-generator that is connected to a hydraulic pump possibly changes with the power supply amount of the electricity storage device. In this case, a ratio of a revolving movement by the revolving electric motor and a boom-raising movement by the hydraulic pump changes, causing the front portion to draw the trace different from that at a normal time.

In addition, even when the power supply amount of the electricity storage device is sufficient, there are some cases where the revolving electric motor or the motor-generator cannot produce sufficient power output due to, for example, a rise of temperatures or the like. Even in this case, there occurs, as similar to the above description, a problem that the trace drawn by the front portion changes.

When the trace drawn by the front portion changes in response to various conditions, an operator is forced to perform an operation different from the usual operation. This causes strange operation feelings, possibly giving extra stress to the operator.

The present invention is made in view of the aforementioned problems in the conventional technology, and an object of the present invention is to provide a hybrid construction machine that can suppress strange operation feelings of an operator even when a power supply amount of an electricity storage device or output of an electric motor becomes insufficient.

(1) For solving the above problems, a hybrid construction machine according to the present invention comprises a vehicle body that is provided with a revolving structure; a working mechanism that is provided on the revolving structure; an engine that is provided on the vehicle body; a motor-generator that is connected mechanically to the engine; an electricity storage device that is connected electrically to the motor-generator; a hydraulic pump that is connected mechanically to the engine; a plurality of actuators that drive the vehicle body or the working mechanism; an actuator operation device that drives the plurality of actuators in accordance with an operating amount; and a controller that controls output of the motor-generator, characterized in that: the controller has a low speed mode for reducing movement speeds of the plurality of actuators in response to conditions of the motor-generator and the electricity storage device and a normal mode in which a reduction in the movement speeds of the plurality of actuators is released, and at the time of performing a compound movement for simultaneously moving two or more actuators of the plurality of actuators in the low speed mode, the controller has a function of reducing the output of the plurality of actuators in such a manner as to hold a ratio of the movement speeds of the plurality of actuators to a ratio in the normal mode.

According to this configuration, the controller has the low speed mode and the normal mode, and at the time of performing the compound movement for simultaneously moving the two or more actuators, the controller has the function of reducing the output of the plurality of actuators in such a manner as to hold the ratio of the movement speeds of the plurality of actuators to the ratio in the normal mode. As a result, even when the movement speed of the actuator is reduced in the low speed mode, the ratio of the movement speeds of the plurality of actuators that are simultaneously driven can be held to a state close to the ratio in the normal mode. Therefore, even in the low speed mode, the compound movement of the plurality of actuators can be performed in a speed ratio close to that in the normal mode to suppress the strange operation feelings of an operator.

(2) According to the present invention, one actuator of the plurality of actuators includes a revolving hydraulic motor that is driven by pressurized oil from the hydraulic pump, the vehicle body is provided with a revolving electric motor that is connected electrically to the motor-generator and the electricity storage device to revolve the revolving structure by compound torque with the revolving hydraulic motor, and the controller is provided with a function of controlling output of the revolving electric motor, wherein when the compound movement is performed in the low speed mode and the revolving electric motor and the motor-generator simultaneously perform powering operations, a reduced value of the output of the motor-generator is made larger than a reduced value of the output of the revolving electric motor.

According to this configuration, the controller controls the reduced value of the output of the motor-generator to be larger than the reduced value of the output of the revolving electric motor when the compound movement is performed in the low speed mode and the revolving electric motor and the motor-generator simultaneously perform powering operations. In general, a revolving electric motor has a higher energy efficiency as compared to a hydraulic pump that is driven by a powering operation of a motor-generator. Therefore, in a compound movement including the revolution, the revolving speed and the movement speed of the actuator can be reduced in a state where the energy efficiency is high.

(3) The present invention further comprises a revolving operation device that is operable to revolve the revolving structure in accordance with an operating amount, wherein the controller determines a ratio of a revolving speed of the revolving structure and a movement speed of an actuator other than the revolving hydraulic motor of the plurality of actuators based upon an operating amount of the revolving operation device and an operating amount of the actuator operation device.

According to this configuration, the controller determines the ratio of the revolving speed of the revolving structure and the movement speed of the actuator based upon the operating amount of the revolving operation device and the operating amount of the actuator operation device. Therefore, even in the low speed mode when the operating amount of each of the revolving operation device and the actuator operation device is set to be approximately the same as in the normal mode, the compound movement can be performed in the speed ratio close to that in the normal mode to suppress the strange operation feelings of an operator.

(4) In the present invention, the controller is configured to change from the normal mode to the low speed mode in response to at least one condition of an electricity storage amount of the electricity storage device, a temperature of the electricity storage device, a temperature of the motor-generator and a temperature of the revolving electric motor.

According to this configuration, the controller is configured to change from the normal mode to the low speed mode in response to at least one condition of the electricity storage amount of the electricity storage device, the temperature of the electricity storage device, the temperature of the motor-generator and the temperature of the revolving electric motor. As a result, since the controller automatically changes into the low speed mode in response to the conditions of the electricity storage device, the motor-generator and the revolving electric motor, the electricity storage device, the motor-generator and the revolving electric motor can be operated within an appropriate use range as much as possible to suppress degradation thereof.

(5) The present invention further comprises a mode selection switch that can select any one of the normal mode and the low speed mode, wherein the controller sets a movement speed of the actuator in accordance with a mode selected by the mode selection switch.

According to this configuration, since there is further provided the mode selection switch that can select any one of the normal mode and the low speed mode, an operator can actively select whether or not the power is saved.

(6) In the present invention, maximum output of the engine is made smaller than maximum power of the hydraulic pump.

According to this configuration, the maximum output of the engine is made smaller than the maximum power of the hydraulic pump. Therefore, in the normal mode, when the hydraulic pump is driven by the maximum power, the hydraulic pump can be driven by causing the motor-generator to perform the powering operation. In addition, in the low speed mode, for example, output by the powering operation of the motor-generator is reduced, making it possible to drive the hydraulic pump.

MODE FOR CARRYING OUT THE INVENTION

Hereinafter, a hybrid hydraulic excavator as an example of a hybrid construction machine according to an embodiment in the present invention will be explained with reference to the accompanying drawings.

Figure 1:
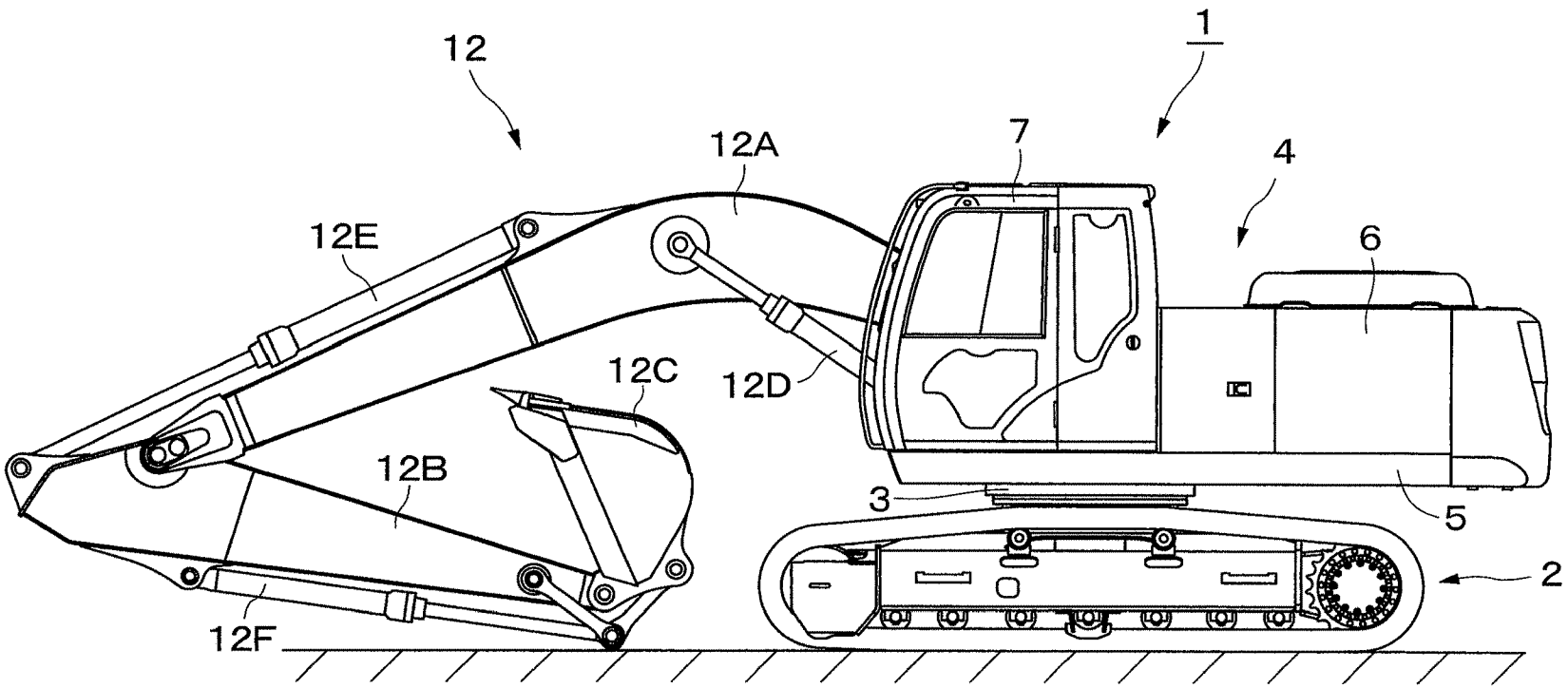
FIG. 1 is a front view showing a hybrid hydraulic excavator according to an embodiment of the present invention.

FIG. 1 to FIG. 16 show an embodiment of the present invention. In FIG. 1, a Hybrid Hydraulic Excavator 1 (Hereinafter, referred to as "hydraulic excavator 1") is provided with an engine 21 and a motor-generator 27, which will be described later. The hydraulic excavator 1 includes an automotive lower traveling structure 2 of a crawler type, a revolving device 3 that is provided on the lower traveling structure 2, an upper revolving structure 4 that is mounted through the revolving device 3 on the lower traveling structure 2 to be capable of revolving thereon, and a working mechanism 12 of an articulated structure that is provided in the front side of the upper revolving structure 4 and performs an excavating operation of earth and sand, and the like. At this time, the lower traveling structure 2 and the upper revolving structure 4 configure a vehicle body of the hydraulic excavator 1.

Figure 12:
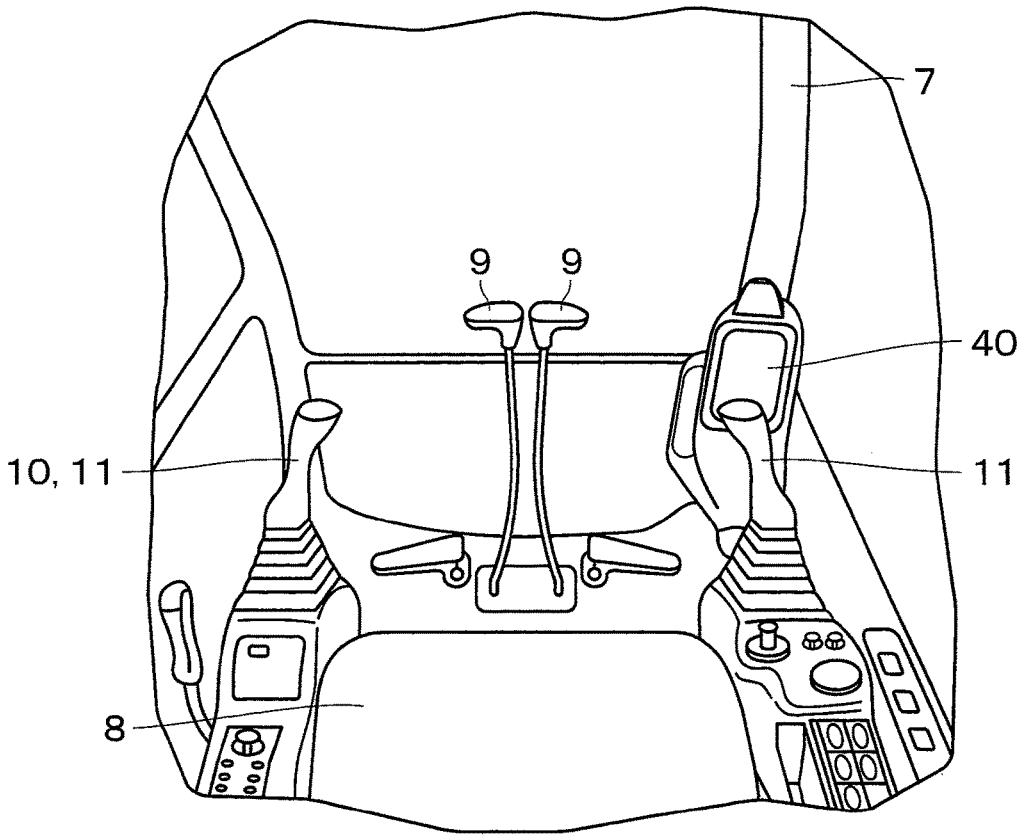
FIG. 12 is a perspective view showing an essential part showing the inside of a cab in FIG. 1.

The upper revolving structure 4 includes a housing cover 6 that is provided on a revolving frame 5 to accommodate the engine 21 to be described later and the like, and a cab 7 for an operator getting in. As shown in FIG. 12, an operator's seat 8 on which an operator sits is provided in the cab 7, and a traveling operation device 9 that is composed of operating levers, operating pedals and the like, a revolving operation device 10 that is composed of an operating lever and the like, and a working operation device 11 that is composed of operating levers and the like are provided in the periphery of the operator's seat 8.

The traveling operation device 9, for example, is arranged in front of the operator's seat 8. The revolving operation device 10, for example, corresponds to an operating section of the operating lever in a front-rear direction arranged in the left side to the operator's seat 8. In addition, the working operation device 11 corresponds to an operating (arm operating) section of the operating lever in a left-right direction arranged in the left side to the operator's seat 8, an operating (boom operating) section of the operating lever in a front-rear direction arranged in the right side to the operator's seat 8, and an operating (bucket operating) section of the operating lever in a left-right direction. At this time, an operation of pulling the right operating lever to the nearside (to the rear side) in a front-rear direction corresponds to an operation of a boom-raising movement. It should be noted that a relation of an operating direction of the operating lever to a revolving movement or a working movement is not limited to the aforementioned relation, but may be optionally set according to a specification of the hydraulic excavator 1 or the like.

Here, the operation devices 9 to 11 are respectively provided with operating amount sensors 9A to 11A that detect their operating amounts (lever operating amounts OAr, OAbu and OAx). The operating amount sensors 9A to 11A configure a vehicle body operating-state detecting device that detects an operating state of the vehicle body, such as a traveling operation of the lower traveling structure 2, a revolving operation of the upper revolving structure 4 or a lifting/tilting operation (excavating operation) of the working mechanism 12. Further, a mode selection switch 38, an engine control dial 39, an in-vehicle monitor 40, which will be described later, and the like are provided in the cab 7.

As shown in FIG. 1, the working mechanism 12 is configured of, for example, a boom 12A, an arm 12B and a bucket 12C, and a boom cylinder 12D, an arm cylinder 12E and a bucket cylinder 12F for driving them. The boom 12A, the arm 12B and the bucket 12C are pinned to each other. The working mechanism 12 is attached to the revolving frame 5, and extends or contracts the cylinders 12D to 12F to perform a lifting/tilting movement.

Here, the hydraulic excavator 1 is provided thereon with an electric system that controls a motor-generator 27 and the like, and a hydraulic system that controls movements of the working mechanism 12 and the like. Hereinafter, an explanation will be made of the system configuration in the hydraulic excavator 1 with reference to FIG. 2 to FIG. 12.

Figure 2:
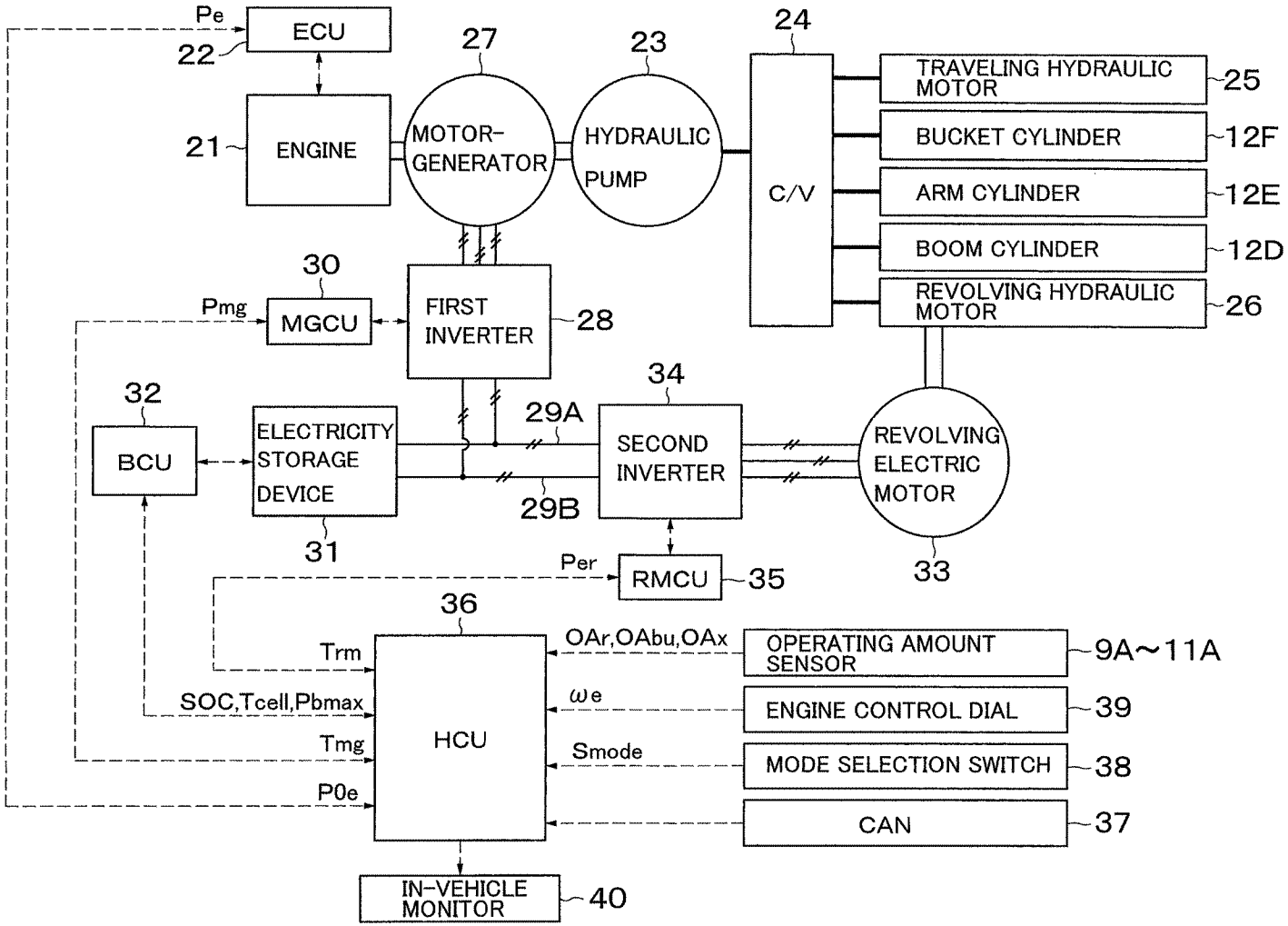
FIG. 2 is a block diagram showing a hydraulic system and an electric system that are applied to the hybrid hydraulic excavator in FIG. 1.

The engine 21 is mounted on the revolving frame 5. The engine 21 is configured of an internal combustion engine such as a diesel engine. As shown in FIG. 2, a hydraulic pump 23 and the motor-generator 27, which will be described later, are attached mechanically to the output side of the engine 21 for serial connection. The hydraulic pump 23 and the motor-generator 27 are driven by the engine 21. Here, an operation of the engine 21 is controlled by an engine control unit 22 (hereinafter, referred to as "ECU 22"). The ECU 22 controls output torque, a rotational speed (engine rotational number) and the like of the engine 21 based upon an engine output command Pe from an HCU 36. The engine 21 is provided with a sensor (not shown) for detecting engine actual output P0*e*, and the engine actual output P0*e* is input into the HCU 36 via a CAN 37 to be described later. It should be noted that the maximum output of the engine 21 is, for example, made smaller than the maximum power of the hydraulic pump 23.

The hydraulic pump 23 is driven by the engine 21. The hydraulic pump 23 pressurizes operating oil reserved in a tank (not shown), which is delivered to a traveling hydraulic motor 25, a revolving hydraulic motor 26, the cylinders 12D to 12F of the working mechanism 12, and the like as pressurized oil.

The hydraulic pump 23 is connected through a control valve 24 to the traveling hydraulic motor 25, the revolving hydraulic motor 26, and the cylinders 12D to 12F as hydraulic actuators (actuators). The control valve 24 supplies or discharges the pressurized oil delivered from the hydraulic pump 23 to the traveling hydraulic motor 25, the revolving hydraulic motor 26, and the cylinders 12D to 12F in response to operations to the traveling operation device 9, the revolving operation device 10 and the working operation device 11.

Specifically, the pressurized oil is delivered to the traveling hydraulic motor 25 from the hydraulic pump 23 in response to an operation of the traveling operation device 9. As a result, the traveling hydraulic motor 25 drives/travels the lower traveling structure 2. The pressurized oil is delivered to the revolving hydraulic motor 26 from the hydraulic pump 23 in response to an operation of the revolving operation device 10. As a result, the revolving hydraulic motor 26 operates/revolves the upper revolving structure 4. The pressurized oil is delivered to the cylinders 12D to 12F from the hydraulic pump 23 in response to the operation of the working operation device 11. As a result, the cylinders 12D to 12F lift/tilt the working mechanism 12.

The motor-generator 27 is driven by the engine 21. The motor-generator 27 is configured of, for example, a synchronous electric motor and the like. The motor-generator 27 plays two roles of electric power generation of performing electric power supply to the electricity storage device 31 and the revolving electric motor 33 by acting as an electric power generator using the engine 21 as a power source, and a powering operation of assisting in driving the engine 21 and the hydraulic pump 23 by acting as a motor using electric power from the electricity storage device 31 and the revolving electric motor 33 as a power source. Accordingly, the assist torque of the motor-generator 27 is added to torque of the engine 21 in response to the condition, and the hydraulic pump 23 is driven by the engine torque and the assist torque. The movement of the working mechanism 12, a travel of the vehicle and the like are performed by the pressurized oil delivered from the hydraulic pump 23.

As shown in FIG. 2, the motor-generator 27 is connected to a pair of DC buses 29A, 29B through a first inverter 28. The first inverter 28 is configured using a plurality of switching elements such as a transistor and an insulating gate bipolar transistor (IGBT), and ON/OFF of each of the switching elements is controlled by a motor-generator control unit 30 (hereinafter, referred to as "MGCU 30"). The DC buses 29A, 29B are paired at a positive terminal side and at a negative terminal side, and, for example, a DC voltage of approximately several hundred V is applied thereto.

At the electric power generation of the motor-generator 27, the first inverter 28 converts AC power from the motor-generator 27 into DC power, which is supplied to the electricity storage device 31 or the revolving electric motor 33. At the powering operation of the motor-generator 27, the first inverter 28 converts the DC power of the DC buses 29A, 29B into AC power, which is supplied to the motor-generator 27. The MGCU 30 controls ON/OFF of each of the switching elements in the first inverter 28 based upon a motor-generator powering operation output command Pmg from the HCU 36 and the like. Thereby, the MGCU 30 controls generated power at the electric power generation of the motor-generator 27 or driving electric power at the powering operation of the motor-generator 27. In addition, the MGCU 30 is provided with a temperature sensor (not shown) for detecting a temperature of the motor-generator 27 (motor-generator temperature Tmg), outputting the motor-generator temperature Tmg to the HCU 36.

The electricity storage device 31 is connected electrically to the motor-generator 27. The electricity storage device 31 is configured of a plurality of cells (not shown) composed of, for example, lithium ion batteries and is connected to the DC buses 29A, 29B.

The electricity storage device 31 charges with electric power supplied from the motor-generator 27 at the electric power generation of the motor-generator 27 and supplies driving electric power toward the motor-generator 27 at the powering operation (at the assist drive) of the motor-generator 27. In addition, the electricity storage device 31 charges with regeneration power supplied from the revolving electric motor 33 at the regeneration of the revolving electric motor 33 and supplies driving electric power toward the revolving electric motor 33 at the powering operation of the revolving electric motor 33. In this way, the electricity storage device 31 stores the electric power generated by the motor-generator 27, and further, absorbs the regeneration power generated by the revolving electric motor 33 at the revolving braking of the hydraulic excavator 1 to hold the voltage of the DC buses 29A, 29B to be constant.

A charge operation or a discharge operation of the electricity storage device 31 is controlled by a battery control unit 32 (hereinafter, referred to as "BCU32"). The BCU32 detects battery allowable discharge power Pbmax, a battery electricity storage rate SOC and a cell temperature Tcell to be outputted to the HCU 36. On the other hand, The BCU32 controls the charge/discharge of the electricity storage device 31 such that the revolving electric motor 33 and the motor-generator 27 are driven in response to an electric/revolving output command Per and the motor-generator powering operation output command Pmg from the HCU 36. At this time, the battery electricity storage rate SOC becomes a value corresponding to the electricity storage amount of the electricity storage device 31.

It should be noted that in the present embodiment, a lithium ion battery, for example, having a voltage of 350 V, a discharge capacity of approximately 5 Ah, an appropriate use range of the battery electricity storage rate SOC (electricity storage rate) set to approximately 30% to 70% is used in the electricity storage device 31. The appropriate use range of the battery electricity storage rate SOC and the like are not limited to the above values, but are set as needed in accordance with a specification of the electricity storage device 31 or the like.

The revolving electric motor 33 is driven by the electric power from the motor-generator 27 or the electricity storage device 31. The revolving electric motor 33 is configured of, for example, a three-phase induction motor, and is provided on the revolving frame 5 together with the revolving hydraulic motor 26. The revolving electric motor 33 drives the revolving device 3 in cooperation with the revolving hydraulic motor 26. Therefore, the revolving device 3 is driven by compound torque of the revolving hydraulic motor 26 and the revolving electric motor 33 to drive/revolve the upper revolving structure 4.

As shown in FIG. 2, the revolving electric motor 33 is connected to the DC buses 29A, 29B through the second inverter 34. The revolving electric motor 33 plays two roles of a powering operation of being driven/rotated by receiving electric power from the electricity storage device 31 or the motor-generator 27, and regeneration of charging the electricity storage device 31 by generating power with extra torque at the revolving braking. Therefore, the electric power from the motor-generator 27 or the electricity storage device 31 is supplied through the DC buses 29A, 29B to the revolving electric motor 33 at the powering operation. Thereby, the revolving electric motor 33 generates rotational torque in response to an operation of the revolving operation device 10 to assist in a drive of the revolving hydraulic motor 26, and drive the revolving device 3 to perform a revolving movement of the upper revolving structure 4.

The second inverter 34 is, as similar to the first inverter 28, configured using a plurality of switching elements. ON/OFF of each of the switching elements in the second inverter 34 is controlled by a revolving electric motor control unit 35 (hereinafter, referred to as "RMCU 35"). At the powering operation of the revolving electric motor 33, the second inverter 34 converts the DC power of the DC buses 29A, 29B into AC power to be supplied to the revolving electric motor 33. At the regeneration of the revolving electric motor 33, the second inverter 34 converts the AC power from the revolving electric motor 33 into DC power to be supplied to the electricity storage device 31 and the like.

The RMCU 35 controls ON/OFF of each of the switching elements in the second inverter 34 based upon the electric/revolving output command Per from the HCU 36 and the like. Thereby, the RMCU 35 controls regeneration power at the regeneration of the revolving electric motor 33 and driving electric power at the powering operation thereof. In addition, the RMCU 35 is provided with a temperature sensor (not shown) for detecting a temperature of the revolving electric motor 33 (revolving electric motor temperature Trm) and outputs the revolving electric motor temperature Trm to the HCU 36.

The hybrid control unit 36 (hereinafter, referred to as "HCU 36") configures a controller. The HCU 36 is configured of, for example, a microcomputer, and is connected electrically to the ECU 22, the MGCU 30, the RMCU 35 and the BCU32 using a CAN 37 (Controller Area Network) and the like. The HCU 36 exchanges communications with the ECU 22, the MGCU 30, the RMCU 35 and the BCU32, and simultaneously controls the engine 21, the motor-generator 27, the revolving electric motor 33 and the electricity storage device 31 respectively.

Battery allowable discharge power Pbmax, a battery electricity storage rate SOC, a cell temperature Tcell, a motor-generator temperature Tmg, engine actual output P0*e*, a revolving electric motor temperature Trm and the like are input through the CAN 37 and the like to the HCU 36. In addition, the operating amount sensors 9A to 11A that detect lever operating amounts OAr, OAbu, OAx of the operation devices 9 to 11 are connected to the HCU 36. Further, the HCU 36 is connected to a mode selection switch 38, an engine control dial 39 and the like. Thereby, the lever operating amounts OAr, OAbu, OAx, low speed mode selection switch information Smode and an engine target rotational speed ωe are input to the HCU 36.

The mode selection switch 38 selects any one of a normal mode NMODE and a low speed mode LSMODE. Here, in the low speed mode LSMODE, for example, when the output beyond the actual output P0*e* of the engine 21 is needed, a movement speed of each of the revolving device 3 and the working mechanism 12 is reduced. On the other hand, in the normal mode NMODE, a reduction in the movement speed by the low speed mode LSMODE is released.

The mode selection switch 38 is configured of, for example, a switch of which ON and OFF are switched, and is switched by an operator. The mode selection switch 38 is arranged in the cab 7 and an output side thereof is connected to the HCU 36. For example, the HCU 36 selects the low speed mode LSMODE when the mode selection switch 38 becomes ON, and selects the normal mode NMODE when the mode selection switch 38 becomes OFF. Therefore, the low speed mode selection switch information Smode corresponding to ON and OFF of the mode selection switch 38 is input to the HCU 36.

The engine control dial 39 is configured of a rotatable dial, and sets the target rotational speed ωe of the engine 21 in accordance with a rotational position of the dial. The engine control dial 39 is positioned in the cab 7 and is operable to be rotated by an operator, outputting a command signal in accordance with the target rotational speed ωe.

The in-vehicle monitor 40 is arranged in the cab 7, and displays various pieces of information in regard to the vehicle body such as a remaining amount of fuel, a water temperature of engine cooling water, a working time and an in-vehicular compartment temperature. In addition thereto, the in-vehicle monitor 40 is connected to the HCU 36, and displays the currently operating mode of the normal mode NMODE and the low speed mode LSMODE.

The HCU 36 controls the output of each of the engine 21, the motor-generator 27 and the revolving electric motor 33 in accordance with the selected mode of the normal mode NMODE and the low speed mode LSMODE. Therefore, next an explanation will be made of a specific structure of the HCU 36 with reference to FIG. 3 to FIG. 11.

Figure 3:
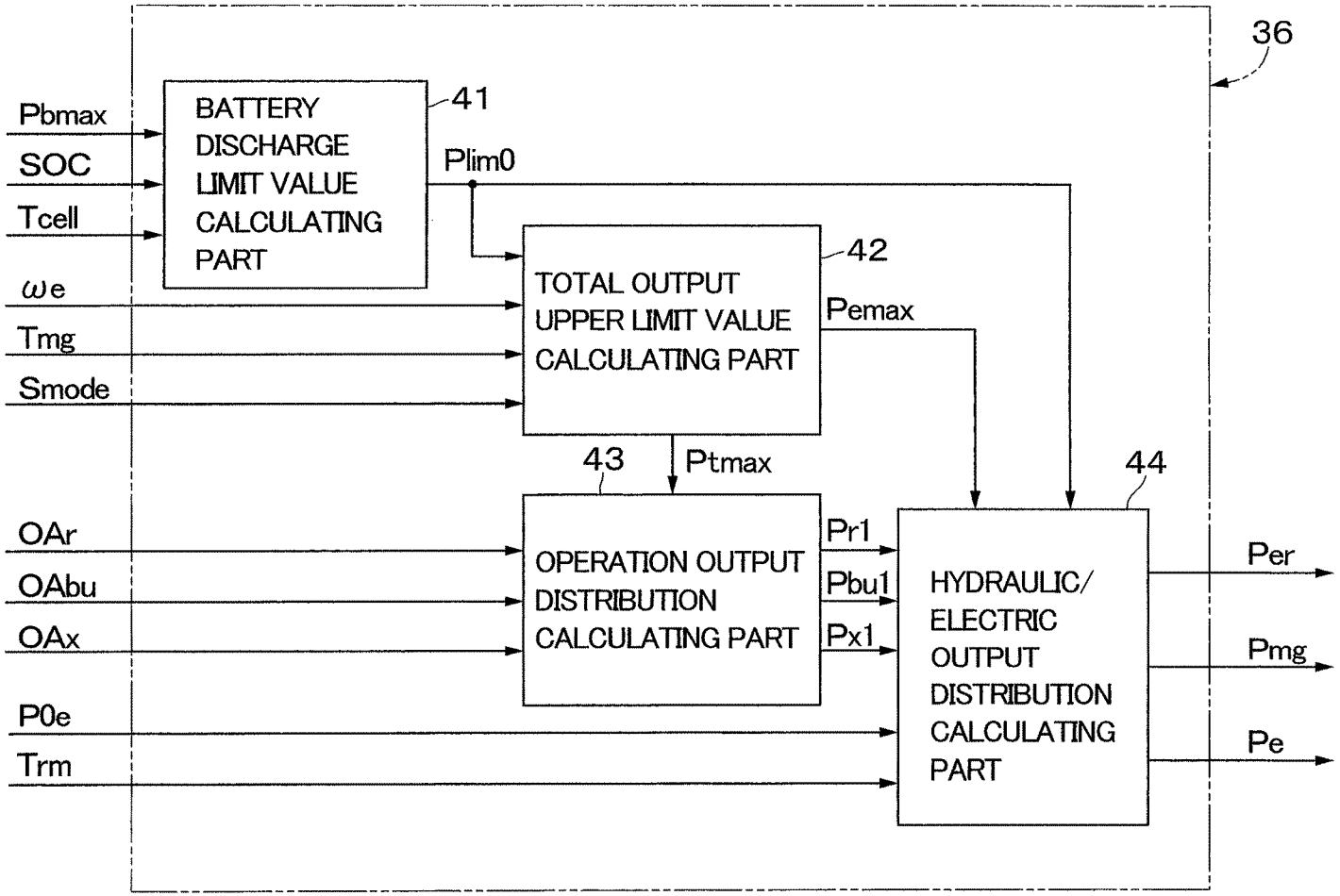
FIG. 3 is a block diagram showing a hybrid control unit in FIG. 2.

As shown in FIG. 3, the HCU 36 includes a battery discharge limit value calculating part 41, a total output upper limit value calculating part 42, an operation output distribution calculating part 43 and a hydraulic/electric output distribution calculating part 44. For example, the battery allowable discharge power Pbmax, the battery electricity storage rate SOC, the cell temperature Tcell, the engine target rotational speed ωe, the motor-generator temperature Tmg, the low speed mode selection switch information Smode, the revolving lever operating amount OAr, the boom-raising lever operating amount OAbu, the other lever operating amount OAx, the engine actual output P0*e* and the revolving electric motor temperature Trm are input to the HCU 36. In addition, the HCU 36 outputs the engine output command Pe, the electric/revolving output command Per and the motor-generator powering operation output command Pmg based upon these inputs.

Figure 4:
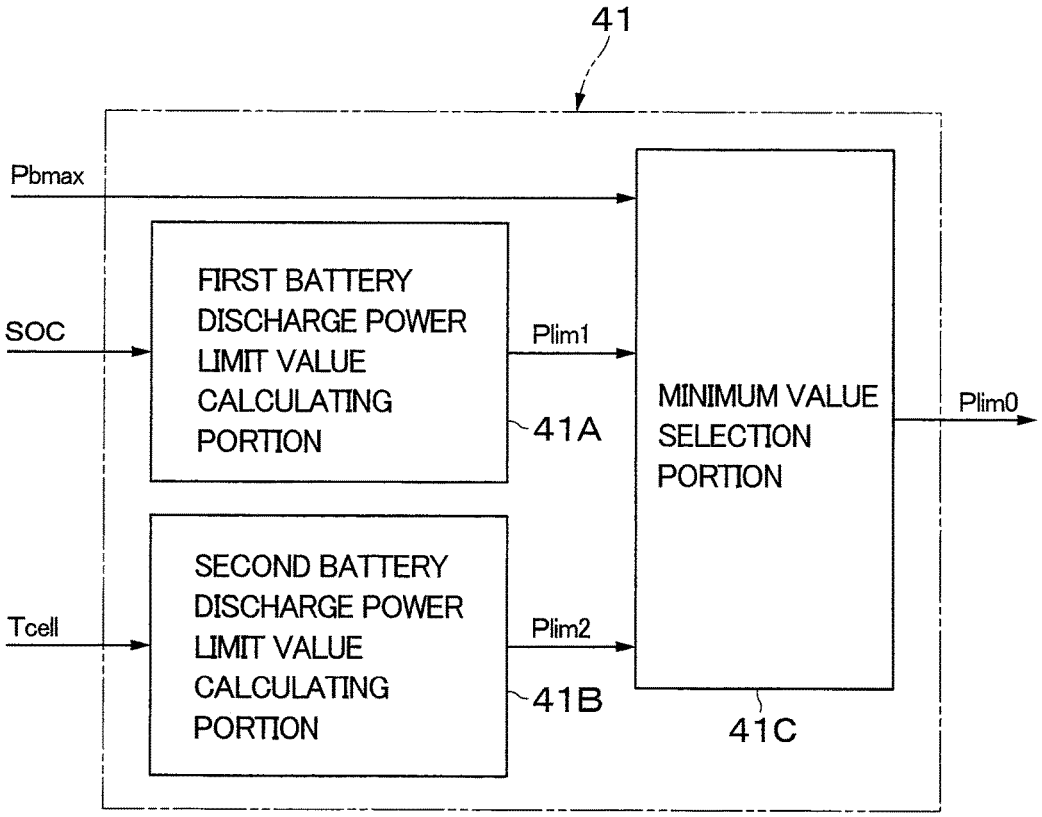
FIG. 4 is a block diagram showing a battery discharge limit value calculating part in FIG. 3.

As shown in FIG. 4, the battery discharge limit value calculating part 41 includes a first battery discharge power limit value calculating portion 41A, a second battery discharge power limit value calculating portion 41B and a minimum value selection portion 41C. The battery electricity storage rate SOC, the cell temperature Tcell and the battery allowable discharge power Pbmax are input to the battery discharge limit value calculating part 41 from the BCU32. At this time, the battery allowable discharge power Pbmax represents electric power that can be discharged by the present electricity storage device 31, and is calculated by a cell voltage or a hardware electrical current upper limit value of the electricity storage device 31, for example.

Figure 5:
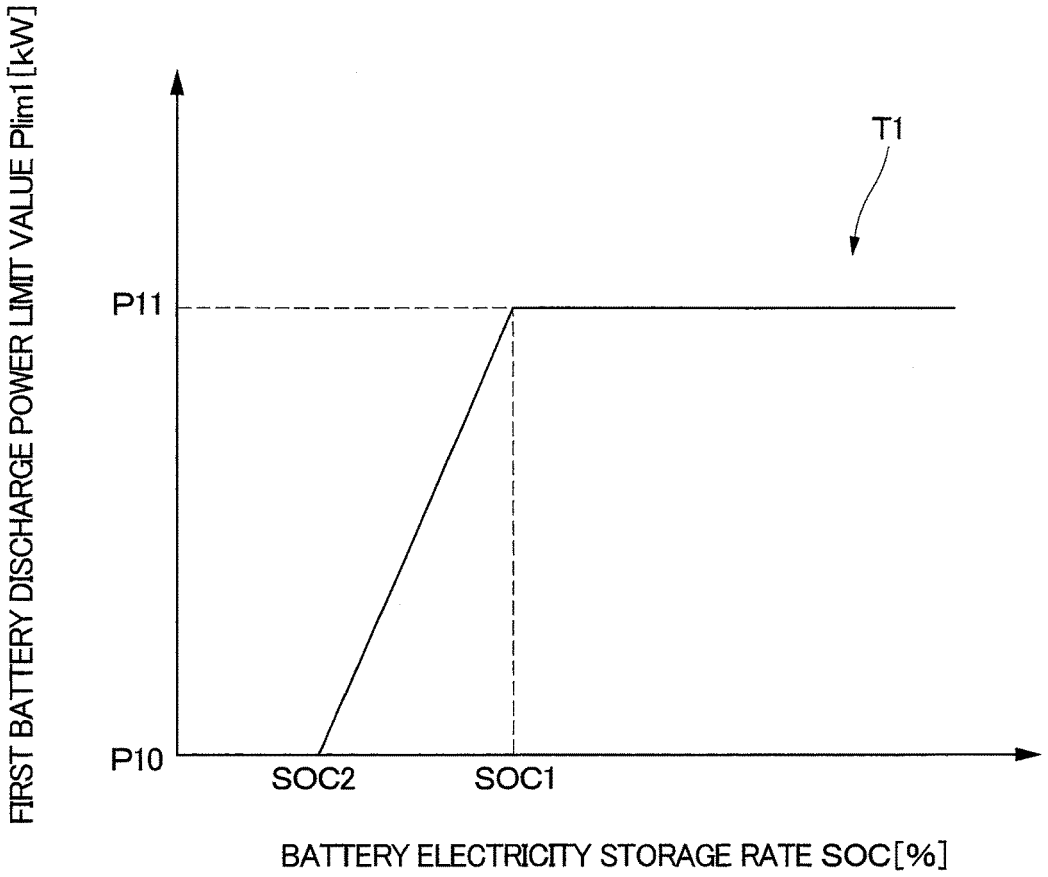
FIG. 5 is an explanatory diagram showing a table for finding a first battery discharge power limit value from a battery electricity storage rate.

Since the first battery discharge power limit value calculating portion 41A, for example, has a table T1 as shown in FIG. 5 for calculating a first battery discharge power limit value Plim1 based upon the battery electricity storage rate SOC. The first battery discharge power limit value calculating portion 41A uses the table T1 to calculate the first battery discharge power limit value Plim1 in accordance with the battery electricity storage rate SOC.

Figure 6:
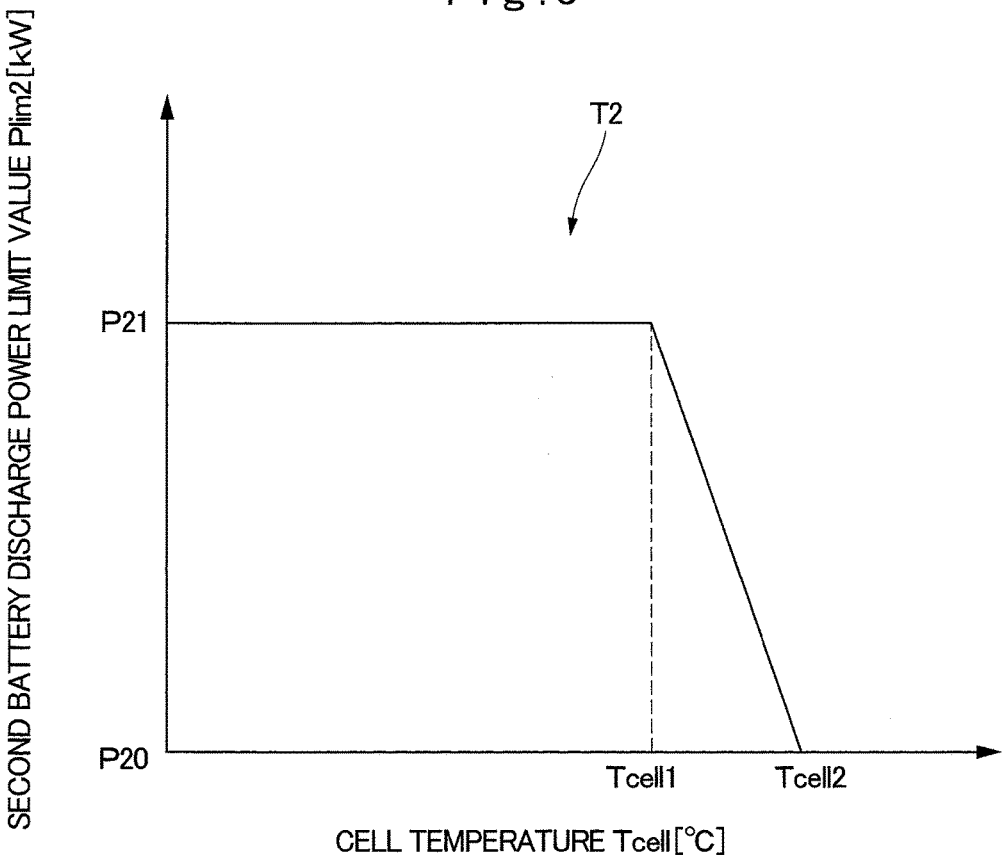
FIG. 6 is an explanatory diagram showing a table for finding a second battery discharge power limit value from a cell temperature.

Since the second battery discharge power limit value calculating portion 41B, for example, has a table T2 as shown in FIG. 6 for calculating a second battery discharge power limit value Plim2 based upon the cell temperature Tcell. The second battery discharge power limit value calculating portion 41B uses the table T2 to calculate the second battery discharge power limit value Plim2 in accordance with the cell temperature Tcell.

At this time, maximum values P11, P21 of the battery discharge power limit values Plim1, Plim2 shown in FIG. 5 and FIG. 6 are set to values close to battery allowable discharge power Pbmax typical when the electricity storage device 31 is a new product and the cell temperature Tcell is a room temperature.

The table T1, when the battery electricity storage rate SOC is lower than a minimum value SOC2 in an appropriate use range, sets the battery discharge power limit value Plim1 to a minimum value P10 (for example, P10=0 kW), and when the battery electricity storage rate SOC is higher than an appropriate reference value SOC1 as a threshold, sets the battery discharge power limit value Plim1 to the maximum value P11. In addition, when the battery electricity storage rate SOC becomes a value between the minimum value SOC2 and the appropriate reference value SOC1, the table T1 increases the battery discharge power limit value Plim1 with an increase in the battery electricity storage rate SOC. Here, the appropriate reference value SOC1 is set to a large value having some margin from the minimum value SOC2. For example, when the minimum value SOC2 is 30%, the appropriate reference value SOC1 is set to a value of approximately 35%.

The table T2, when the cell temperature Tcell is higher than a maximum value Tcell2 in an appropriate use range, sets the battery discharge power limit value Plim2 to a minimum value P20 (for example, P20=0 kW). On the other hand, the table T2, when the cell temperature Tcell is lower than the appropriate reference value Tcell1 as a threshold, sets the battery discharge power limit value Plim2 to the maximum value P21. In addition, when the cell temperature Tcell becomes a value between the maximum value Tcell2 and the appropriate reference value Tcell1, the table T2 lowers the battery discharge power limit value Plim2 with an increase in the cell temperature Tcell. Here, the appropriate reference value Tcell1 is set to a small value having some margin from the maximum value Tcell2. For example, when the maximum value Tcell2 is 60° C., the appropriate reference value Tcell1 is set to a value of approximately 50° C.

A minimum value selection portion 41C compares the three values of the battery discharge power limit values Plim1, Plim2 calculated by the first and second battery discharge power limit value calculating portions 41A, 41B and the battery allowable discharge power Pbmax, and selects a minimum value thereof to be outputted as a battery discharge power limit value Plim0.

Figure 7:
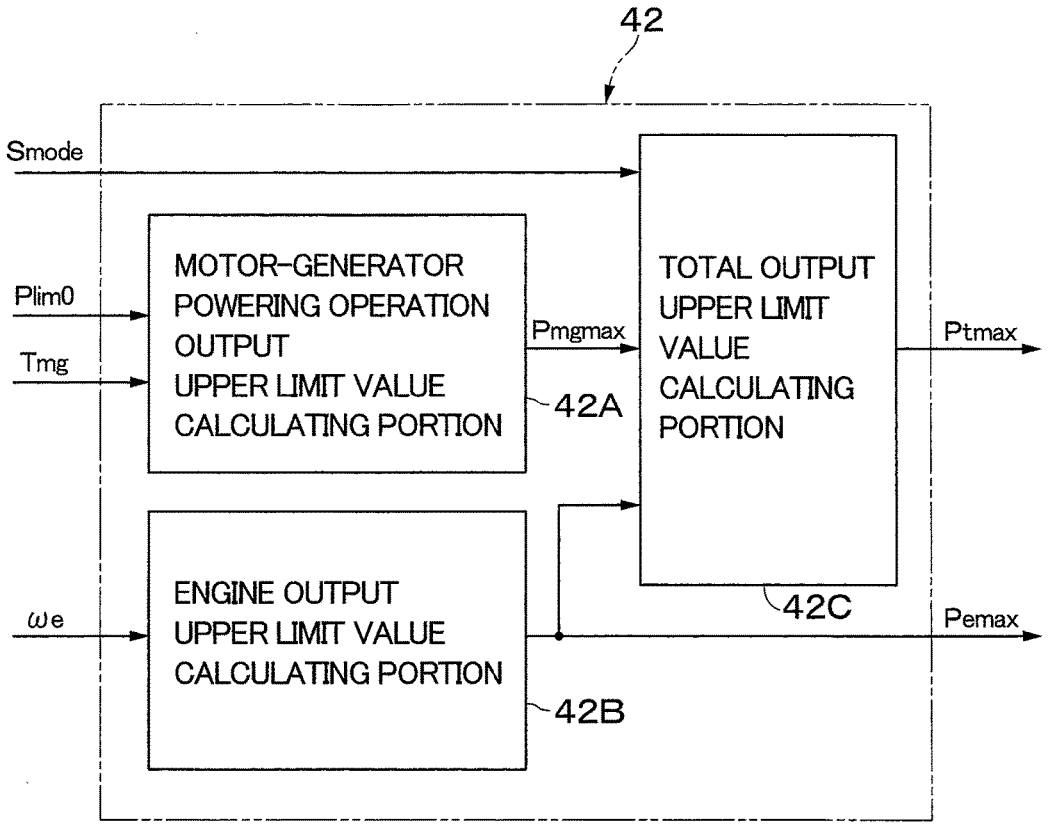
FIG. 7 is a block diagram showing a total output upper limit value calculating part in FIG. 3.

As shown in FIG. 7, the total output upper limit value calculating part 42 includes a motor-generator powering operation output upper limit value calculating portion 42A, an engine output upper limit value calculating portion 42B and a total output upper limit value calculating portion 42C. The battery discharge power limit value Plim0, the target rotational speed ωe of the engine 21 determined by a command of the engine control dial 39 and the like, the motor-generator temperature Tmg and the low speed mode selection switch information Smode are input to the total output upper limit value calculating part 42.

The motor-generator powering operation output upper limit value calculating portion 42A calculates the output when the motor-generator 27 performs a powering operation at the maximum in a range of the battery discharge power limit value Plim0 to be outputted as a motor-generator output upper limit value Pmgmax. At this time, the motor-generator powering operation output upper limit value calculating portion 42A calculates the motor-generator output upper limit value Pmgmax considering hardware restrictions such as a temperature Tmg and an efficiency of the motor-generator 27.

Figure 8:
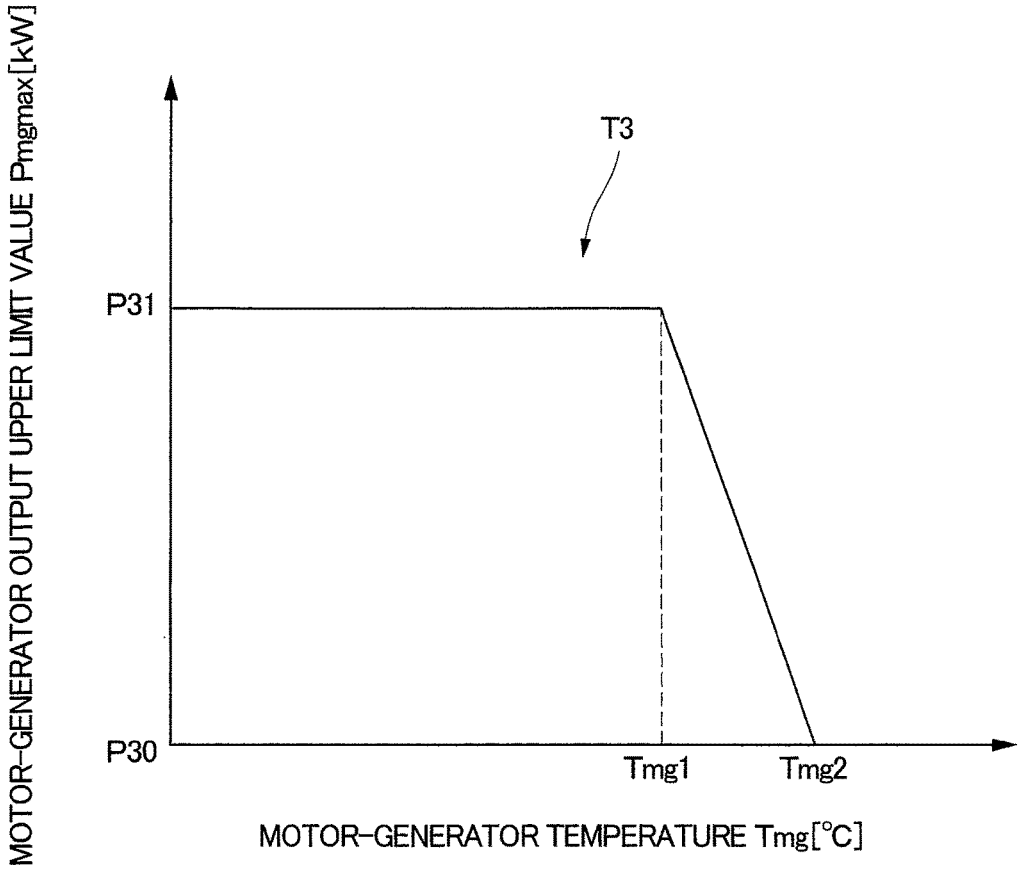
FIG. 8 is an explanatory diagram showing a table for finding a motor-generator output upper limit value from a motor-generator temperature.

Specifically, the motor-generator powering operation output upper limit value calculating portion 42A has a table T3, for example, as shown in FIG. 8. The motor-generator powering operation output upper limit value calculating portion 42A uses the table T3 to calculate the motor-generator output upper limit value Pmgmax in accordance with the motor-generator temperature Tmg.

The table T3, when the motor-generator temperature Tmg is higher than a maximum value Tmg2 in an appropriate use range, sets the motor-generator output upper limit value Pmgmax to a minimum value P30. On the other hand, the table T3, when the motor-generator temperature Tmg is lower than an appropriate reference value Tmg1 as a threshold, sets the motor-generator output upper limit value Pmgmax to a maximum value P31. In addition, when the motor-generator temperature Tmg becomes a value between the maximum value Tmg2 and the appropriate reference value Tmg1, the table T3 lowers the motor-generator output upper limit value Pmgmax with an increase in the motor-generator temperature Tmg. Here, the appropriate reference value Tmg1 is set to a small value having some margin from the maximum value Tmg2.

The engine output upper limit value calculating portion 42B calculates an output maximum value of the engine 21 that can be outputted in the target rotational speed ωe to be outputted as an engine output upper limit value Pemax.

The total output upper limit value calculating portion 42C calculates a total amount (Pmgmax+Pemax) of the motor-generator output upper limit value Pmgmax as a powering operation output upper limit value of the motor-generator 27 calculated in the motor-generator powering operation output upper limit value calculating portion 42A and the engine output upper limit value Pemax calculated in the engine output upper limit value calculating portion 42B.

In addition, the total output upper limit value calculating portion 42C has a mode output upper limit value Pmodemax. The mode output upper limit value Pmodemax is an upper limit value that can be outputted from the motor-generator 27 and the engine 21 in each mode (the low speed mode LSMODE and the normal mode NMODE). Therefore, the mode output upper limit value Pmodemax is set as different values respectively at ON and OFF of the mode selection switch 38.

For example, when the mode selection switch 38 is "ON", the low speed mode LSMODE is selected. At this time, the mode output upper limit value Pmodemax in the low speed mode LSMODE is set to a smaller value as compared to that when the mode selection switch 38 is "OFF" and the normal mode NMODE is selected.

Accordingly, the total output upper limit value calculating portion 42C acquires the mode selected by the mode selection switch 38 based upon the low speed mode selection switch information Smode, and sets the mode output upper limit value Pmodemax in accordance with the selected mode. In addition, the total output upper limit value calculating portion 42C compares the mode output upper limit value Pmodemax with a total value of the motor-generator output upper limit value Pmgmax and the engine output upper limit value Pemax, and outputs a smaller value thereof as a total output upper limit value Ptmax.

Figure 9:
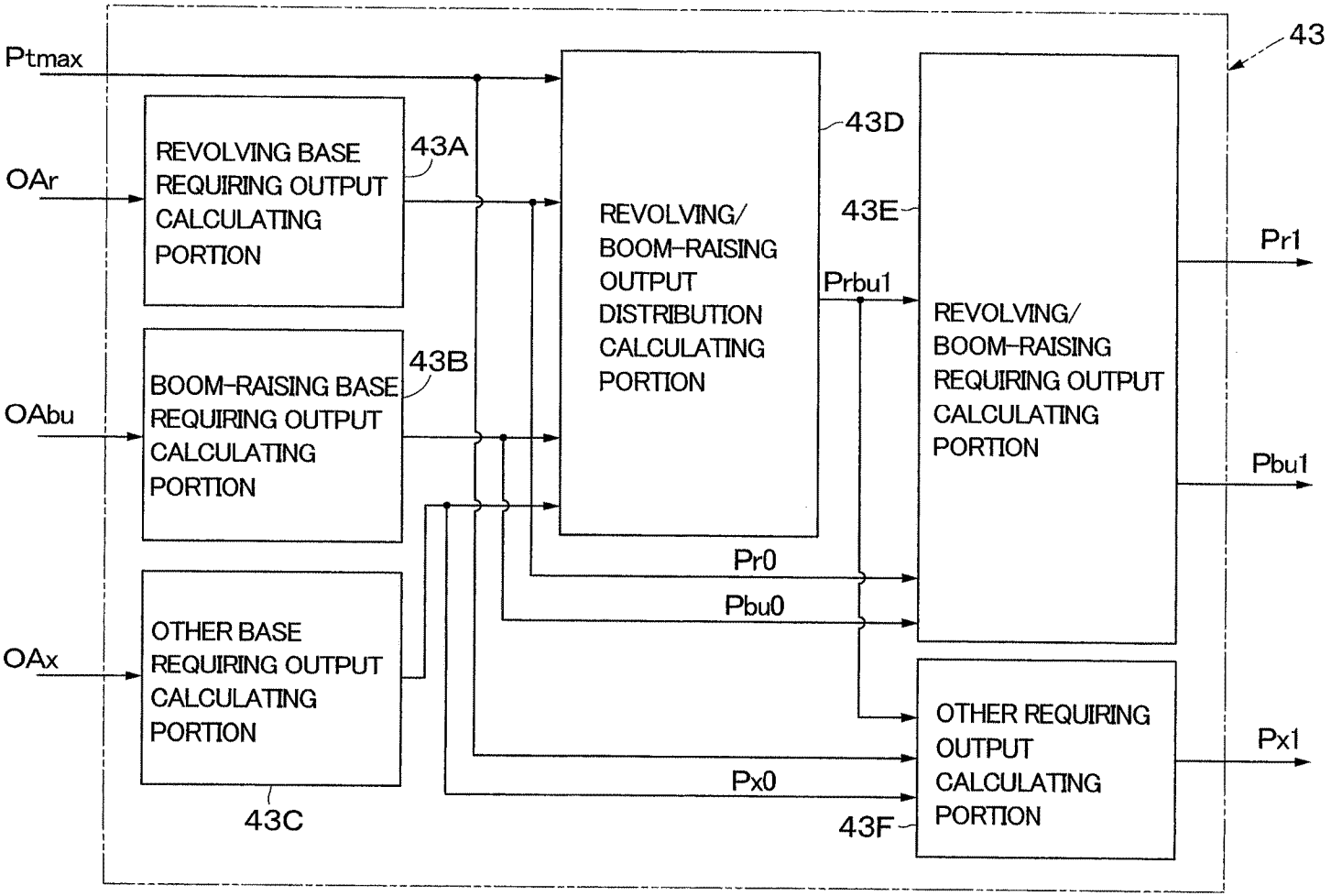
FIG. 9 is a block diagram showing an operation output distribution calculating part in FIG. 3.

As shown in FIG. 9, the operation output distribution calculating part 43 includes a revolving base requiring output calculating portion 43A, a boom-raising base requiring output calculating portion 43B, the other base requiring output calculating portion 43C, a revolving/boom-raising output distribution calculating portion 43D, a revolving/boom-raising requiring output calculating portion 43E and the other requiring output calculating portion 43F. The total output upper limit value Ptmax, the revolving lever operating amount OAr, the boom-raising lever operating amount OAbu and the other lever operating amount OAx are input to the operation output distribution calculating part 43. It should be noted that in FIG. 9, the other lever operating amount OAx is collectively described as one, but actually includes a plurality of kinds of lever operating amounts such as an arm lever operating amount, a bucket lever operating amount and the like.

The revolving base requiring output calculating portion 43A calculates revolving base requiring output Pr0 monotonically increasing to the revolving lever operating amount OAr. A value of the revolving base requiring output Pr0 is tuned to the extent that a revolving independent movement can be fully performed.

The boom-raising base requiring output calculating portion 43B calculates a boom-raising base requiring output Pbu0 monotonically increasing to the boom-raising lever operating amount OAbu. A value of the boom-raising base requiring output Pbu0 is tuned to the extent that a boom-raising independent movement for raising the boom 12A can be fully performed.

The other base requiring output calculating portion 43C, as similar to the revolving base requiring output calculating portion 43A and the boom-raising base requiring output calculating portion 43B, calculates other base requiring output Px0 monotonically increasing to respective lever operating amounts included in the other lever operating amount OAx. A value of the other base requiring output Px0 is tuned to the extent that an independent movement of each lever can be fully performed.

The revolving/boom-raising output distribution calculating portion 43D determines how much extent of the total output upper limit value Ptmax is distributed to the revolving/boom-raising movement, and calculates revolving/boom-raising requiring output Prbu1. At this time, the revolving/boom-raising movement is a compound movement of performing the revolving movement and the boom-raising movement together.

For example, even in the revolving/boom-raising movement only, in a case where the electricity storage device 31 cannot sufficiently supply electric power due to a reduction in the battery electricity storage rate SOC or an increase in the cell temperature Tcell, the total output upper limit value Ptmax is made small as described before. In this case, the revolving/boom-raising output distribution calculating portion 43D reduces a value to be distributed to the revolving/boom-raising movement, that is, a value of the revolving/boom-raising requiring output Prbu1 to be small in accordance with the total output upper limit value Ptmax. In addition, for example, even in a case where the other movement having higher priority than the revolving/boom-raising movement is simultaneously required as the traveling movement, the revolving/boom-raising output distribution calculating portion 43D reduces the value of the revolving/boom-raising requiring output Prbu1 to be small.

The revolving/boom-raising requiring output calculating portion 43E calculates a ratio of the revolving base requiring output Pr0 and the boom-raising base requiring output Pbu0. The revolving/boom-raising requiring output calculating portion 43E distributes the revolving/boom-raising requiring output Prbu1 to the revolving movement and the boom-raising movement in accordance with this ratio, and calculates and outputs revolving requiring output Pr1 in accordance with the revolving movement and boom-raising requiring output Pbu1 in accordance with the boom-raising movement.

The other requiring output calculating portion 43F calculates a difference between the total output upper limit value Ptmax and the revolving/boom-raising requiring output Prbu1. The other requiring output calculating portion 43F appropriately distributes this difference in accordance with the other base requiring output Px0, and outputs other requiring output Px1.

Here, the revolving/boom-raising movement of compounding the two movements of the revolving movement and the boom-raising movement is used as an example to perform the output distribution in regard to the revolving/boom-raising movement. However, the present invention is not limited thereto, but a compound movement composed of three movements by adding one operation among a plurality of the operations collected as the others to the revolving movement and the boom-raising movement can be also applied by expanding the revolving/boom-raising output distribution calculating portion 43D.

For example, in a case of simultaneously performing an arm pulling movement of pulling the arm 12B together with the revolving/boom-raising movement, the revolving/boom-raising output distribution calculating portion 43D is expanded to a revolving/boom-raising/arm-pulling output distribution calculating portion. At this time, the revolving/boom-raising/arm-pulling output distribution calculating part ensures total output by addition of the revolving/boom-raising movement and the arm pulling movement from the total output upper limit value Ptmax, and only distributes the output not to change a speed ratio of the boom raising and the arm pulling to the revolving speed as described before. It is possible to add a bucket movement to the revolving/boom-raising movement by performing the similar expansion.

Figure 10:
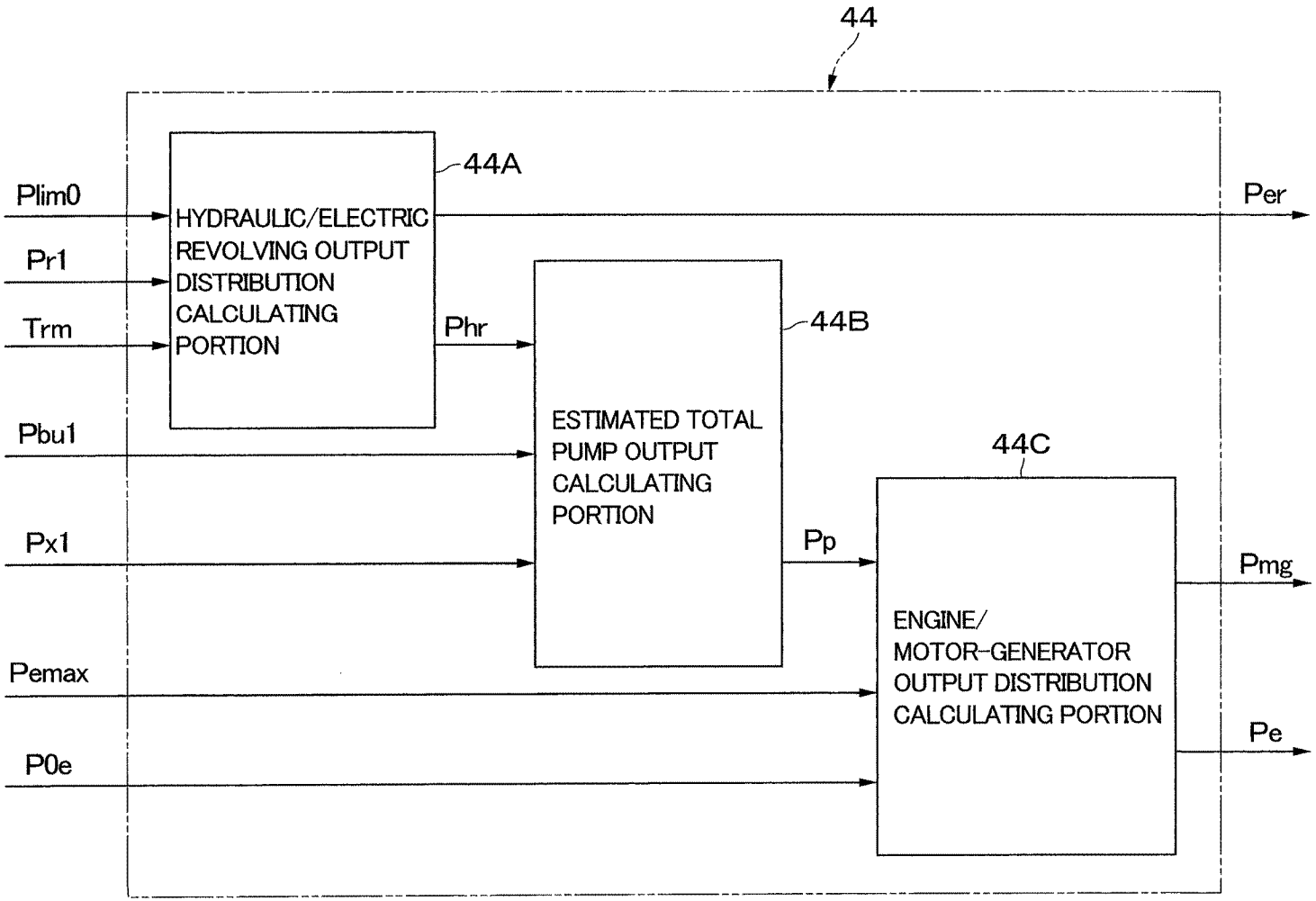
FIG. 10 is a block diagram showing a hydraulic/electric output distribution calculating part in FIG. 3.

As shown in FIG. 10, the hydraulic/electric output distribution calculating part 44 includes a hydraulic/electric revolving output distribution calculating portion 44A, an estimated total pump output calculating portion 44B and an engine/motor-generator output distribution calculating portion 44C. The battery discharge power limit value Plim0, the revolving requiring output Pr1, the revolving electric motor temperature Trm, the boom-raising requiring output Pbu1, the other requiring output Px1, the engine output upper limit value Pemax and the engine actual output P0*e* are input to the hydraulic/electric output distribution calculating part 44.

The hydraulic/electric revolving output distribution calculating portion 44A calculates the output when the revolving electric motor 33 performs a powering operation at the maximum in a range of the battery discharge power limit value Plim0 as a revolving electric motor powering operation upper limit value Prmmax. At this time, the hydraulic/electric revolving output distribution calculating portion 44A calculates the revolving electric motor powering operation upper limit value Prmmax considering hardware restrictions such as a temperature Trm and an efficiency of the revolving electric motor 33.

Figure 11:
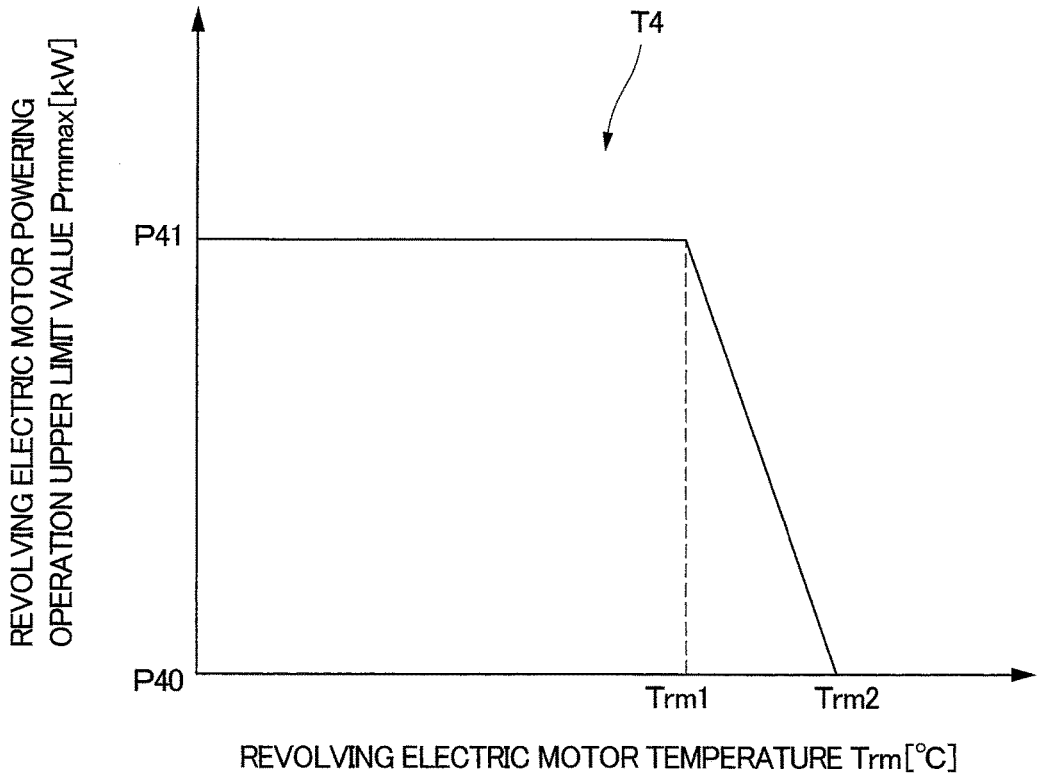
FIG. 11 is an explanatory diagram showing a table for finding a revolving electric motor powering operation upper limit value from a revolving electric motor temperature.

Specifically, the hydraulic/electric revolving output distribution calculating portion 44A has a table T4, for example, as shown in FIG. 11. The hydraulic/electric revolving output distribution calculating portion 44A uses the table T4 to calculate the revolving electric motor powering operation upper limit value Prmmax in accordance with the revolving electric motor temperature Trm.

The table T4, when the revolving electric motor temperature Trm is higher than a maximum value Trm2 in an appropriate use range, sets the revolving electric motor powering operation upper limit value Prmmax to a minimum value P40. On the other hand, the table T4, when the revolving electric motor temperature Trm is lower than an appropriate reference value Trm1 as a threshold, sets the revolving electric motor powering operation upper limit value Prmmax to a maximum value P41. In addition, when the revolving electric motor temperature Trm becomes a value between the maximum value Trm2 and the appropriate reference value Trm1, the table T4 lowers the revolving electric motor powering operation upper limit value Prmmax with an increase in the revolving electric motor temperature Trm. Here, the appropriate reference value Trm1 is set to a small value having some margin from the maximum value Trm2.

The hydraulic/electric revolving output distribution calculating portion 44A compares the revolving electric motor powering operation upper limit value Prmmax with the revolving requiring output Pr1, and outputs the smaller one as the electric/revolving output command Per. When a value of the revolving requiring output Pr1 is larger than the revolving electric motor powering operation upper limit value Prmmax, since the electric/revolving output command Per is the revolving electric motor powering operation upper limit value Prmmax, the hydraulic/electric revolving output distribution calculating portion 44A outputs a difference (Pr1−Per) between the electric/revolving output command Per and the revolving requiring output Pr1, as a hydraulic revolving output command Phr. On the other hand, when the revolving electric motor powering operation upper limit value Prmmax is larger than the revolving requiring output Pr1, since the revolving movement is performed by the revolving electric motor 33 alone, the hydraulic/electric revolving output distribution calculating portion 44A sets the hydraulic revolving output command Phr as (Phr=0 kW) to be outputted.

The estimated total pump output calculating portion 44B calculates a total value of the hydraulic revolving output command Phr, the boom-raising requiring output Pbu1 and the other requiring output Px1. The estimated total pump output calculating portion 44B calculates estimated total pump output Pp considering a pump efficiency from this total amount, and outputs the estimated total pump output Pp.

The engine/motor-generator output distribution calculating portion 44C, when the estimated total pump output Pp is larger than the engine actual output P0*e*, outputs this difference as the motor-generator powering operation output command Pmg, and outputs the engine output upper limit value Pemax as the engine output command Pe. In reverse, when the engine actual output P0*e* is larger than the estimated total pump output Pp, the motor-generator powering operation output command Pmg is set as 0 (Pmg=0 kW), and outputs the estimated total pump output Pp as the engine output command Pe.

By using the hydraulic/electric output distribution calculating part 44 as configured above, the usable battery discharge power is distributed to the revolving electric motor 33 as much as possible, and the remaining electric power is distributed to the powering operation of the motor-generator 27 in a case where hydraulic loads cannot be ensured by the output of the engine 21 only. Accordingly, in a case where the discharge power of the electricity storage device 31 is restricted by the electricity storage amount (battery electricity storage rate SOC) or the cell temperature Tcell, the electric power supply of the motor-generator 27 is reduced more preferentially than the revolving electric motor 33.

In general, a compound efficiency of the electricity storage device 31, the inverters 28, 34 and the revolving electric motor 33 is superior to an efficiency of the hydraulic pump 23. That is, in the revolving movement, the electric revolution by use of the battery power in the electricity storage device 31 is better in energy efficiency than the hydraulic revolution by driving the hydraulic pump 23. The hydraulic/electric output distribution calculating part 44 distributes the battery discharge power to the revolving electric motor 33 more preferentially than the motor-generator 27 in consideration of this respect.

The hybrid hydraulic excavator according to the present embodiment has the configuration as described above, and next, an explanation will be made of an output distribution at the time of performing the revolving/boom-raising compound movement in the normal mode NMODE and in the low speed mode LSMODE with reference to FIG. 13 to FIG. 16. It should be noted that FIG. 13 to FIG. 16 show an example of the output distribution in a case of performing the revolving/boom-raising movement alone. In addition, values indicated in FIG. 13 to FIG. 16 show an example of the output, and may be changed as needed by a specification of the hydraulic excavator 1 and the like.

Figure 13:
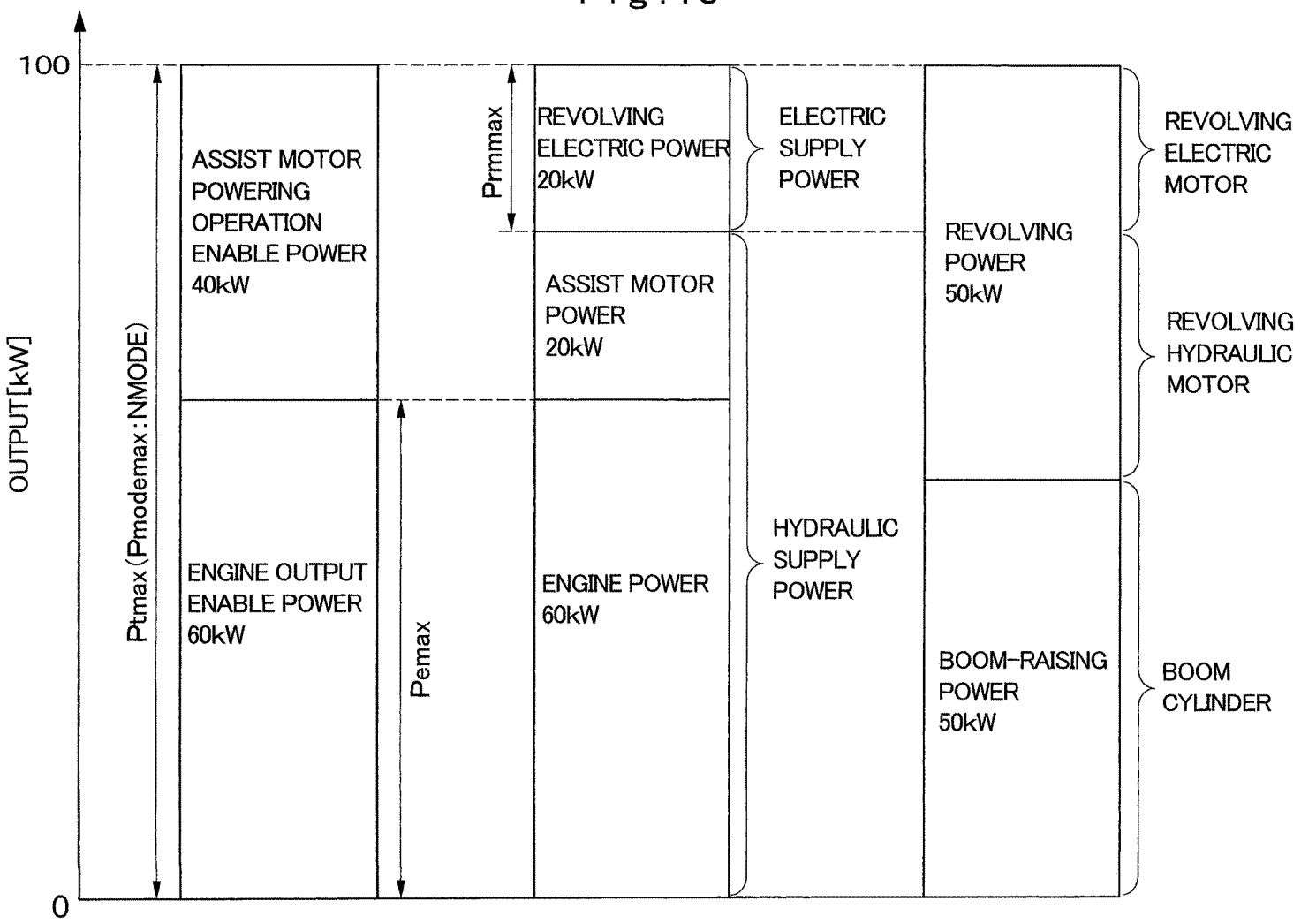
FIG. 13 is an explanatory diagram showing an output distribution in a normal mode.

First, an explanation will be made of the output distribution in the normal mode NMODE. As shown in FIG. 13, in the normal mode NMODE, the HCU 36 sets the mode output upper limit value Pmodemax of the normal mode NMODE to, for example, 100 kW, and sets the engine output upper limit value Pemax to, for example, 60 kW in accordance with the engine target rotational speed ωe and the like. At this time, the total output upper limit value Ptmax is set to 100 kW by the mode output upper limit value Pmodemax. In addition, the total output upper limit value Ptmax is power that can be supplied by the engine 21 and the electricity storage device 31, and is a total value of power that can be supplied by a powering operation of the motor-generator 27 in consideration of a state of the electricity storage device 31 and power that can be outputted by the engine 21 (engine output upper limit value Pemax).

On the other hand, the HCU 36 determines a ratio between the revolving requiring output Pr1 and the boom-raising requiring output Pbu1 based upon the revolving lever operating amount OAr and the boom-raising lever operating amount OAbu. At this time, since the excavator performs the revolving/boom-raising movement alone and does not perform the other movement, the total output upper limit value Ptmax is distributed to two movements of the revolving movement and the boom-raising movement. If the output of the revolving movement and the output of the boom-raising movement are made in the same ratio based upon the revolving lever operating amount OAr and the boom-raising lever operating amount OAbu, the HCU 36 divides the total output upper limit value Ptmax into halves, which are distributed to the revolving movement and the boom-raising movement respectively. Therefore, the revolving output and the boom-raising output both are 50 kW, for example.

Here, the revolving electric motor powering operation upper limit value Prmmax is assumed to be 20 kW, for example. At this time, the revolving electric motor powering operation upper limit value Prmmax is a smaller value than 50 kW of the revolving output. Therefore, 20 kW corresponding to the revolving electric motor powering operation upper limit value Prmmax of the 50 kW of the revolving output is distributed to the revolving electric motor 33, and the remaining 30 kW is distributed to the revolving hydraulic motor 26. As a result, 20 kW of the electric power to be supplied from the electricity storage device 31 is distributed to the revolving electric motor 33, and 20 kW thereof is distributed to the powering operation of the motor-generator 27. At this time, 20 kW of the 100 kW of the revolving/boom-raising movement becomes electric supply power, and 80 kW thereof becomes hydraulic supply power.

Next, an explanation will be made of the output distribution in the low speed mode LSMODE. Here, the total output upper limit value Ptmax is restricted by the low speed mode LSMODE, but the other conditions such as the engine target rotational speed ωe, the revolving lever operating amount OAr and the boom-raising lever operating amount OAbu are respectively the same as in the normal mode NMODE as shown in FIG. 13.

Figure 14:
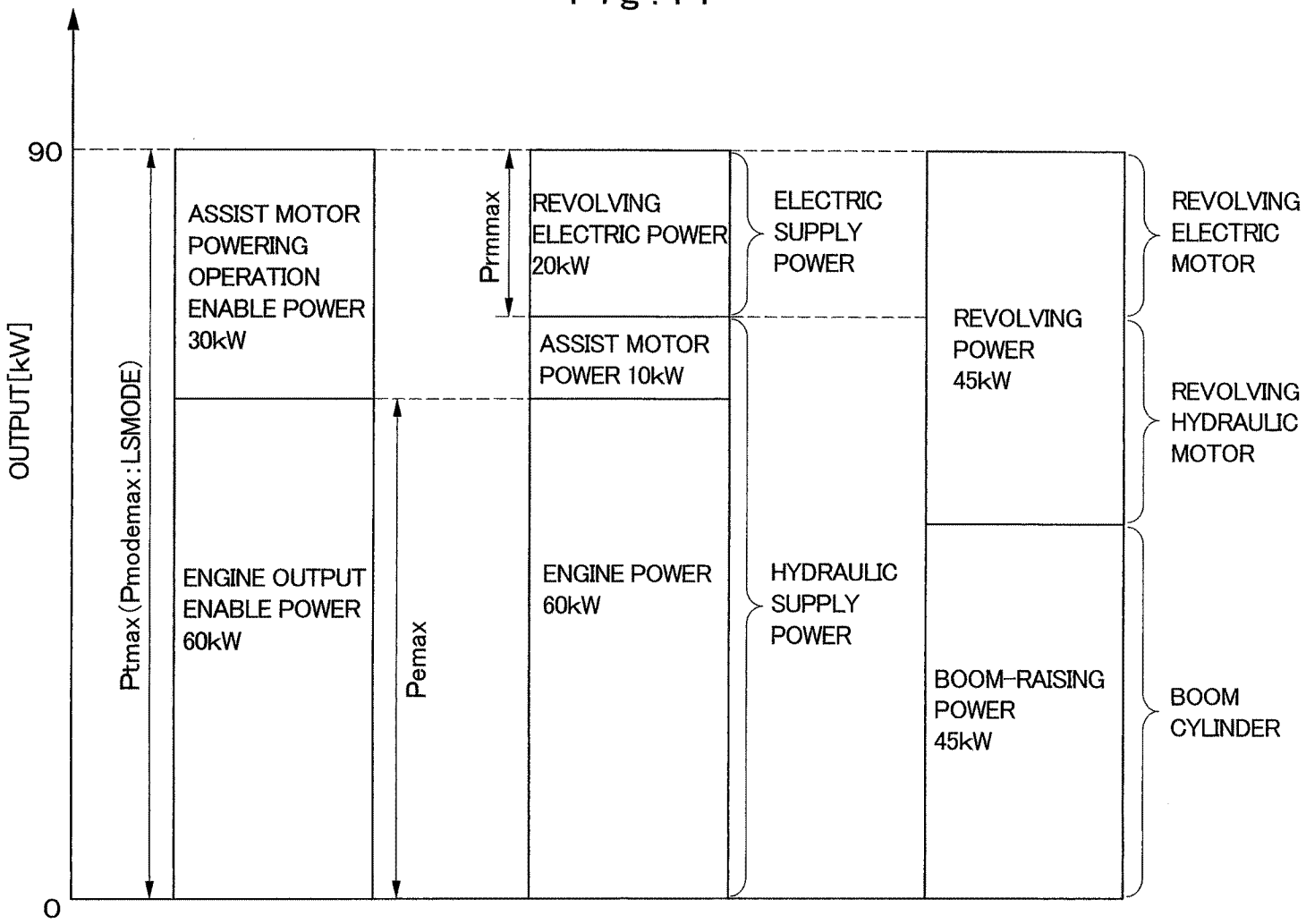
FIG. 14 is an explanatory diagram showing an output distribution at the time of changing into a low speed mode based upon a mode selection switch.

As shown in FIG. 14, for example, when the low speed mode LSMODE is selected by the mode selection switch 38, the HCU 36 sets the mode output upper limit value Pmodemax of the low speed mode LSMODE to, for example, 90 kW. On the other hand, since the engine target rotational speed ωe is the same as in the normal mode NMODE, the engine output upper limit value Pemax is set to the same as in the normal mode NMODE, for example, 60 kW. At this time, the total output upper limit value Ptmax is lower than in the normal mode NMODE, and is set to 90 kW by the mode output upper limit value Pmodemax. The total output upper limit value Ptmax is power that can be supplied by the engine 21 and the electricity storage device 31, and is a total value of power that can be supplied by a powering operation of the motor-generator 27 and power that can be outputted by the engine 21.

On the other hand, the HCU 36 determines a ratio between the revolving requiring output Pr1 and the boom-raising requiring output Pbu1 based upon the revolving lever operating amount OAr and the boom-raising lever operating amount OAbu. Since the revolving lever operating amount OAr and the boom-raising lever operating amount OAbu both are the same as those in the normal mode NMODE, a ratio of the output of the revolving movement and the output of the boom-raising movement is the same value as in the normal mode NMODE. Accordingly, since the output of the revolving movement and the output of the boom-raising movement have the same ratio, the HCU 36 divides the total output upper limit value Ptmax into halves, which are distributed to the revolving movement and the boom-raising movement respectively. Therefore, the revolving output and the boom-raising output both are 45 kW, for example.

At this time, 20 kW as the revolving electric motor powering operation upper limit value Prmmax is a smaller value than 45 kW of the revolving output. Therefore, 20 kW of the electric power to be supplied from the electricity storage device 31 is distributed to the revolving electric motor 33, and 10 kW thereof is distributed to the powering operation of the motor-generator 27. At this time, 20 kW of the 90 kW of the revolving/boom-raising movement becomes electric supply power, and 70 kW thereof becomes hydraulic supply power.

As described above, the usable battery discharge power is distributed to the revolving electric motor 33 as much as possible, and the remaining electric power is distributed to the powering operation of the motor-generator 27 in a case where hydraulic loads cannot be ensured by the output of the engine 21 only. Accordingly, in a case where the total output upper limit value Ptmax is reduced by the mode output upper limit value Pmodemax to restrict the discharge power of the electricity storage device 31, the electric power supply of the motor-generator 27 is reduced more preferentially than the revolving electric motor 33.

It should be noted that FIG. 14 explains as an example a case where the low speed mode LSMODE is selected by the mode selection switch 38, which causes the total output upper limit value Ptmax to be reduced. On the other hand, even in a case where the discharge power of the electricity storage device 31 is restricted by the battery electricity storage rate SOC or the cell temperature Tcell, the total output upper limit value Ptmax is lowered. Therefore, since the battery electricity storage rate SOC is lower than an appropriate reference value SOC1 as a threshold or the cell temperature Tcell is higher than an appropriate reference value Tcell1 as a threshold, the HCU 36 automatically transfers to the low speed mode LSMODE in which the total output upper limit value Ptmax is reduced.

Figure 15:
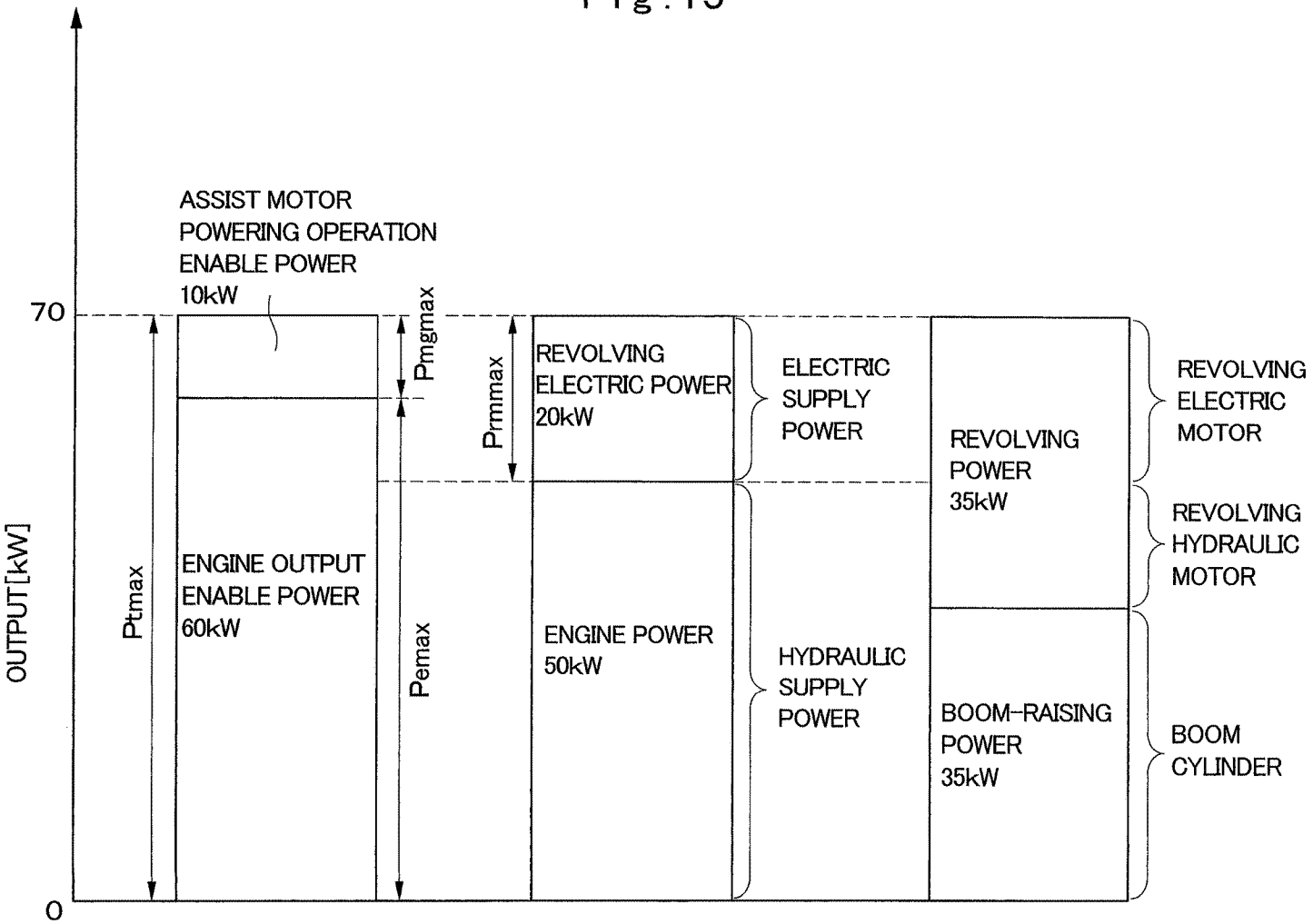
FIG. 15 is an explanatory diagram showing an output distribution at the time of changing into a low speed mode based upon a motor-generator temperature.

In addition, FIG. 15 shows a case where the output (generated power) of the motor-generator 27 is restricted by the motor-generator temperature Tmg. Here, the other conditions such as the engine target rotational speed ωe, the revolving lever operating amount OAr and the boom-raising lever operating amount OAbu are respectively the same as in the normal mode NMODE as shown in FIG. 13.

In this case, the motor-generator temperature Tmg increases to be higher than an appropriate reference value Tmg1 as a threshold and the motor-generator output upper limit value Pmgmax is reduced to, for example, 10 kW. Therefore, the total output upper limit value Ptmax reduces with the motor-generator output upper limit value Pmgmax, and is set to 70 kW as a total value of the motor-generator output upper limit value Pmgmax and the engine output upper limit value Pemax. As a result, since the total value of the output usable in the revolving/boom-raising movement is reduced to 70 kW, the HCU 36 divides the 70 kW into halves, which are distributed to the revolving movement and the boom-raising movement respectively. Thereby, the revolving output and the boom-raising output both are 35 kW, for example.

Here, since the revolving electric motor powering operation upper limit value Prmmax is 20 kW, 20 kW of the electric power to be supplied from the electricity storage device 31 is distributed to the revolving electric motor 33. Since the remaining 50 kW of the total output upper limit value Ptmax can be all supplied by the engine 21, the HCU 36 sets the output of the engine 21 to 50 kW. On the other hand, for putting the motor-generator 27 in a non-load state, the HCU 36 causes the motor-generator 27 to be in a state not to perform any one of the electric power generation and the powering operation. As a result, 20 kW of the 70 kW of the revolving/boom-raising movement becomes electric supply power, and 50 kW thereof becomes hydraulic supply power.

In this way, even in a case where the output of the motor-generator 27 is restricted by the motor-generator temperature Tmg, a total value (the total output upper limit value Ptmax) of the output usable in the revolving/boom-raising movement is reduced. Therefore, when the motor-generator temperature Tmg increases to be higher than the appropriate reference value Tmg1 as the threshold, the HCU 36 automatically transfers to the low speed mode LSMODE in which the output usable in the revolving/boom-raising movement and the like is reduced.

Figure 16:
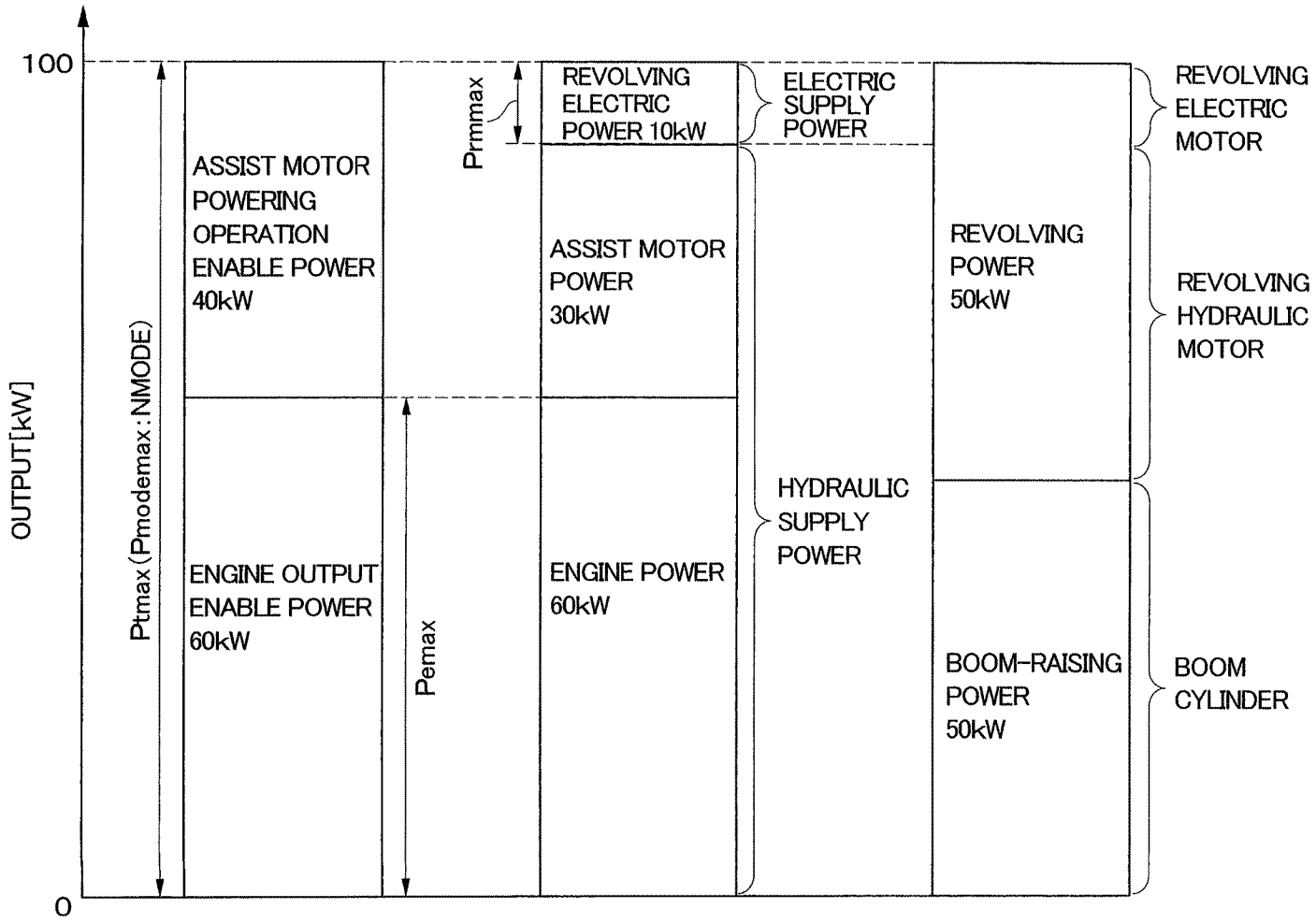
FIG. 16 is an explanatory diagram showing an output distribution at the time of changing into a low speed mode based upon a revolving electric motor temperature.

In addition, FIG. 16 shows a case where the output of the revolving electric motor 33 is restricted by the revolving electric motor temperature Trm. Here, the other conditions such as the engine target rotational speed ωe, the revolving lever operating amount OAr and the boom-raising lever operating amount OAbu are respectively the same as those in the normal mode NMODE as shown in FIG. 13.

In this case, the total output upper limit value Ptmax becomes 100 kW as similar to the normal mode NMODE. Therefore, the HCU 36 divides the 100 kW into halves, which are distributed to the revolving movement and the boom-raising movement respectively. Thereby, the revolving output and the boom-raising output both are 50 kW, for example.

However, the revolving electric motor temperature Trm increases to be higher than the appropriate reference value Trm1 as a threshold and the revolving electric motor powering operation upper limit value Prmmax is reduced to, for example, 10 kW. Therefore, 10 kW of the electric power to be supplied from the electricity storage device 31 is distributed to the revolving electric motor 33, and 30 kW thereof is distributed to the powering operation of the motor-generator 27. As a result, 10 kW of 100 kW of the revolving/boom-raising movement becomes electric supply power, and 90 kW thereof becomes hydraulic supply power.

In this way, in a case where the output of the revolving electric motor 33 is restricted by the revolving electric motor temperature Trm, a ratio of the electric supply power and the hydraulic supply power changes. Therefore, the electric supply power is reduced and the hydraulic supply power is increased. On the other hand, the revolving output and the boom-raising output both become 50 kW that is the same as in the normal mode NMODE. Therefore, operability of the revolving/boom-raising by an operator is maintained in the same state with the normal mode NMODE.

It should be noted that in FIG. 16, there is shown an example where even in a case where the output of the revolving electric motor 33 is restricted by the revolving electric motor temperature Trm, a total value (total output upper limit value Ptmax) of the output usable in the revolving/boom-raising movement is held in the same value with the normal mode NMODE. However, the present invention is not limited thereto, but in a case where the output of the revolving electric motor 33 is restricted, a total value of the output usable in the revolving/boom-raising movement may be reduced. In this case, when the revolving electric motor temperature Trm increases to be higher than the appropriate reference value Trm1 as the threshold, the HCU 36 automatically transfers to the low speed mode LSMODE in which the output usable in the revolving/boom-raising movement and the like is reduced.

Thus, according to the present embodiment, the HCU 36 has the low speed mode LSMODE and the normal mode NMODE. The HCU 36 has a function of reducing outputs of the revolving electric motor 33, the revolving hydraulic motor 26, the boom cylinder 12D and the like such that the ratio of the revolving speed of the upper revolving structure 4 and the movement speed of raising the boom 12A is held to the ratio in the normal mode NMODE at the time of performing the compound movement of the revolving movement and the boom-raising movement in the low speed mode LSMODE. Thereby, even when the movement speed of the boom cylinder 12D is reduced in the low speed mode LSMODE, the ratio of the revolving speed of the upper revolving structure 4 and the movement speed of the boom cylinder 12D can be held to state close to the ratio in the normal mode NMODE.

In addition, the HCU 36 determines the ratio of the revolving speed of the upper revolving structure 4 and the movement speed of the boom raising based upon the lever operating amount OAr of the revolving movement by the revolving operation device 10 and the lever operating amount OAbu of the boom-raising movement by the working operation device 11. Therefore, even in the low speed mode LSMODE, when the lever operating amount OAr of the revolving operation device 10 and the lever operating amount OAbu of the working operation device 11 are approximately the same as in the normal mode NMODE, the compound movement of the revolving/boom-raising can be performed in the speed ratio close to that in the normal mode NMODE to suppress the strange operation feelings of an operator.

Further, the HCU 36 increases a reduced value of the output of the motor-generator 27 to be larger than a reduced value of the output of the revolving electric motor 33 when the compound movement is performed in the low speed mode LSMODE and the revolving electric motor 33 and the motor-generator 27 simultaneously perform the powering operations. Therefore, in the compound movement of the revolving movement and the boom-raising movement, the electric power can be supplied to the revolving electric motor 33 having the high energy efficiency more preferentially, and the revolving speed and the boom-raising movement speed can be reduced in a state where the energy efficiency is high.

In addition, the HCU 36 changes from the normal mode NMODE to the low speed mode LSMODE in response to at least one condition of the battery electricity storage rate SOC of the electricity storage device 31, the cell temperature Tcell, the motor-generator temperature Tmg and the revolving electric motor temperature Trm. As a result, since the HCU 36 automatically changes into the low speed mode LSMODE in response to the conditions of the electricity storage device 31, the motor-generator 27 and the revolving electric motor 33, the electricity storage device 31, the motor-generator 27 and the revolving electric motor 33 can be operated within the appropriate use range as much as possible to suppress degradation thereof.

In addition thereto, the HCU 36 is configured to increase a speed reducing degree of the revolving electric motor 33, the revolving hydraulic motor 26, the boom cylinder 12D and the like in accordance with a reducing degree of the battery electricity storage rate SOC of the electricity storage device 31, or an increasing degree of the cell temperature Tcell, the motor-generator temperature Tmg and the revolving electric motor temperature Trm. Accordingly, as compared to a case where the speed reducing degree is fixed, it is possible to reduce a possibility that the electricity storage device 31, the motor-generator 27 and the revolving electric motor 33 are out of the appropriate use range to enhance an effect of the degradation suppression thereof.

Since there is further provided the mode selection switch 38 that can select any one of the normal mode NMODE and the low speed mode LSMODE, an operator can actively select whether to save the electric power or not.

According to this configuration, the maximum output of the engine 21 is made smaller than the maximum power of the hydraulic pump. Therefore, in the normal mode NMODE, when the hydraulic pump 23 is driven by the maximum power, the powering operation of the motor-generator 27 can assist in the engine 21 to drive the hydraulic pump 23. In addition, in the low speed mode LSMODE, for example, the output by the powering operation of the motor-generator 27 is reduced, making it possible to drive the hydraulic pump 23. Further, since the maximum output of the engine 21 is made smaller than the maximum power of the hydraulic pump 23, it is possible to use the engine 21 that is small-sized and can reduce a fuel consumption.

It should be noted that in the above embodiment, the HCU 36 is provided with two kinds of modes composed of the normal mode NMODE and the low speed mode LSMODE. However, the present invention is not limited thereto, but by adding a heavy load mode in which the battery discharge power limit value Plim0 of the electricity storage device 31 is temporarily released in response to heavy loads to the normal mode NMODE and the low speed mode LSMODE, three kinds of modes may be provided or four kinds of modes may be provided.

In the above embodiment, whether or not the low speed mode LSMODE is made is switched by the mode selection switch 38, but the selection or switch of the mode may be performed by a dial, a lever or the like.

In the above embodiment, the HCU 36 increases the reduced value of the output of the motor-generator 27 to be larger than the reduced value of the output of the revolving electric motor 33 when the compound movement of the revolving/boom-raising is performed in the low speed mode LSMODE, but the reduced value of the output of the revolving electric motor 33 may be made larger than the reduced value of the output of the motor-generator 27 or the reduced values of both may be approximately the same.

In the above embodiment, the HCU 36 is configured to change from the normal mode NMODE to the low speed mode LSMODE in response to the battery electricity storage rate SOC as a value corresponding to the electricity storage amount of the electricity storage device 31, but the electricity storage amount of the electricity storage device 31 itself may be used to transfer from the normal mode NMODE to the low speed mode LSMODE.

In the above embodiment, the HCU 36 is configured to transfer from the normal mode NMODE to the low speed mode LSMODE based upon the battery electricity storage rate SOC, the cell temperature Tcell, the motor-generator temperature Tmg and the revolving electric motor temperature Trm. However, the HCU 36 does not necessarily perform the mode transfer based upon all of these factors. The HCU 36 is only configured to change from the normal mode NMODE to the low speed mode LSMODE in response to at least one condition of the battery electricity storage rate SOC, the cell temperature Tcell, the motor-generator temperature Tmg and the revolving electric motor temperature Trm. Further, the mode transfer may be performed by the mode selection switch 38 alone, eliminating an automatic mode transfer.

In the above embodiment, the maximum output of the engine 21 is made smaller than the maximum power of the hydraulic pump 23, but the maximum output of the engine 21 is set as needed in accordance with a specification of the hydraulic excavator 1 or the like. Therefore, the maximum output of the engine 21 may be approximately the same as the maximum power of the hydraulic pump 23, or may be smaller than the maximum power of the hydraulic pump 23.

In the above embodiment, an example of using the lithium ion battery in the electricity storage device 31 is explained, but a secondary battery (for example, nickel cadmium battery or nickel hydrogen battery) or a capacitor that can supply required electric power may be adopted. In addition, a step-up and -down device such as a DC-DC converter may be provided between the electricity storage device and the DC bus.

In the above embodiment, there is explained an example of the revolving/boom-raising movement for simultaneously performing the revolving movement and the boom-raising movement as the compound movement of simultaneously moving two or more actuators. However, the present invention is not limited thereto, but may be applied to a compound movement of simultaneously performing an arm movement and a boom movement, a compound movement of simultaneously performing a revolving movement and an arm movement, a compound movement of simultaneously performing a traveling movement and a movement of a working mechanism or the like, or may be applied to a compound movement of simultaneously performing not only the two actuators, but three or more actuators.

In the above embodiment, an example of using the hybrid hydraulic excavator 1 of a crawler type as the hybrid construction machine is explained. However, the present invention is not limited thereto, but the present invention may be applied to a hybrid construction machine that is only provided with a motor-generator jointed to an engine and a hydraulic pump, and an electricity storage device, and may be applied to various types of construction machines such as a wheel type hybrid hydraulic excavator, a hybrid wheel loader or a hybrid lift truck.

DESCRIPTION OF REFERENCE NUMERALS

1: Hybrid-type hydraulic excavator
2: Lower traveling structure (Vehicle body)
4: Upper revolving structure (Vehicle body)
9: Traveling operation device
10: Revolving operation device
11: Working operation device
12: Working mechanism
12D: Boom cylinder (Actuator)
12E: Arm cylinder (Actuator)
12F: Bucket cylinder (Actuator)
21: Engine
23: Hydraulic pump
25: Traveling hydraulic motor (Actuator)
26: Revolving hydraulic motor (Actuator)
27: Motor-generator
31: Electricity storage device
33: Revolving electric motor
36: Hybrid control unit (Controller)
38: Mode selection switch

The invention claimed is:

1. A hybrid construction machine comprising:
a vehicle body that is provided with a revolving structure;
a working mechanism that is provided on said revolving structure;
an engine that is provided on said vehicle body;
a motor-generator that is connected mechanically to said engine;
an electricity storage device that is connected electrically to said motor-generator;
a hydraulic pump that is connected mechanically to said engine;
a plurality of actuators that drive said vehicle body or said working mechanism, and include a boom cylinder and a revolving hydraulic motor that are driven by pressurized oil from said hydraulic pump;
a revolving electric motor that is provided on said vehicle body and connected electrically to said motor-generator and said electricity storage device to revolve said revolving structure by compound torque with said revolving hydraulic motor;
an actuator operation device that drives said plurality of actuators in accordance with an operating amount; and
a controller that controls output of said motor-generator and has a low speed mode for reducing movement speeds of said plurality of actuators in response to conditions of said motor-generator and said electricity storage device and a normal mode in which a reduction in the movement speeds of said plurality of actuators is released characterized in that:
said controller is configured to reduce output of said boom cylinder and said revolving hydraulic motor in such a manner as to hold a ratio of output of revolving movement and output of boom-raising movement to the same value of a ratio in said normal mode at the time of performing a compound movement that includes said revolving movement and said boom-raising movement of said working mechanism in said low speed mode, and is configured to control output of said revolving electric motor, and
said controller increases a reduced value of the output of said motor-generator to be larger than a reduced value of the output of said revolving electric motor when said compound movement is performed in said low speed mode and said revolving electric motor and said motor-generator simultaneously perform powering operations.

2. The hybrid construction machine according to claim 1, wherein
said actuator operation device includes a revolving operation device that is operable to revolve said revolving structure in accordance with an operating amount, and
said controller determines a ratio of the output of said revolving movement and the output of said boom-raising movement based upon an operating amount of said boom-raising movement of said revolving operation device and an operating amount of said actuator operation device.

3. The hybrid construction machine according to claim 1, wherein said controller is configured to change from said normal mode to said low speed mode in response to at least one condition of an electricity storage amount of said electricity storage device, a temperature of said electricity storage device, a temperature of said motor-generator and a temperature of said revolving electric motor.

4. The hybrid construction machine according to claim 1, further comprising a mode selection switch that can select any one of said normal mode and said low speed mode, wherein said controller sets the output of said boom cylinder and said revolving hydraulic motor and the output of said revolving electric motor in accordance with a mode selected by said mode selection switch.

5. The hybrid construction machine according to claim 1, wherein maximum output of said engine is made smaller than maximum power of said hydraulic pump.

* * * * *